United States Patent [19]

Dorosz et al.

[11] 4,373,458

[45] Feb. 15, 1983

[54] METHOD AND MACHINE FOR VERSATILE STITCHING

[75] Inventors: Adolph S. Dorosz, Beverly; Patrick N. Kirwan, Danvers, both of Mass.; Nicholas P. Szydlek, Exeter, N.H.

[73] Assignee: USM Corporation, Farmington, Conn.

[21] Appl. No.: 271,023

[22] Filed: Jun. 4, 1981

Related U.S. Application Data

[63] Continuation of Ser. No. 924,840, Jul. 14, 1978, abandoned.

[51] Int. Cl.[3] ..... D05B 21/00

[52] U.S. Cl. ..... 112/121.12; 83/925 CC

[58] Field of Search ..... 112/266.1, 163, 121.11, 112/167, 78, 121.12, 266, 308, 164, 165, 166, 205, 262.3; 83/925 CC, 747; 408/35, 43, 44, 50

[56] References Cited

U.S. PATENT DOCUMENTS

| | | | |
|---|---|---|---|
| 295,524 | 3/1884 | Clough | 408/35 |
| 2,203,804 | 6/1940 | Der Essen . | |
| 2,854,936 | 10/1958 | Nicolay . | |
| 2,868,152 | 1/1959 | Benink et al. . | |
| 3,450,076 | 6/1969 | Bender | 112/121.12 X |
| 3,589,222 | 6/1971 | Sederberg | 83/925 CC X |
| 3,677,207 | 7/1972 | Iwase . | |
| 4,090,281 | 5/1978 | Hautau | 408/35 X |
| 4,178,862 | 12/1979 | Bianchi et al. | 112/121.11 |

FOREIGN PATENT DOCUMENTS

| | | |
|---|---|---|
| 668577 | 8/1963 | Canada . |
| 105693 | 9/1898 | Fed. Rep. of Germany . |
| 937504 | 12/1955 | Fed. Rep. of Germany . |
| 1485139 | 5/1969 | Fed. Rep. of Germany . |
| 2251299 | 10/1973 | Fed. Rep. of Germany . |
| 2513179 | 10/1975 | Fed. Rep. of Germany . |
| 2164151 | 6/1976 | Fed. Rep. of Germany . |
| 2655283 | 6/1978 | Fed. Rep. of Germany . |
| 2927069 | 1/1980 | Fed. Rep. of Germany . |
| 48-37426 | 10/1973 | Japan . |
| 13108 | of 1899 | United Kingdom . |

*Primary Examiner*—Werner H. Schroeder
*Assistant Examiner*—Andrew M. Falik
*Attorney, Agent, or Firm*—William F. White

[57] ABSTRACT

A method and machine are provided for controlling the orientation of one or more sewing instrumentalities with respect to a workpiece while also controlling the path of movement of the workpiece. The one or more sewing instrumentalities are preferably rotated about an axis perpendicular to the plane in which the workpiece is moved. The invention furthermore provides for separate and independent control of each sewing instrumentality so as to thereby render one or both needles inoperative at various times during continuous operation of the machine. The invention still further provides for separate manipulation of the thread associated with each respective sewing instrumentality so as to allow for a pullback of this thread. In principle the invention is also applicable to other than sewing machines wherein one or more operative tools may, for example, perform such functions as marking, folding, pinking, or perforating.

35 Claims, 15 Drawing Figures

178
T
8
186
198
182
192
184
190
189
194
182
184
192
198
194
170
188

178
186
T
182
182
T
189
180
184
T
189
194

Fig. 9
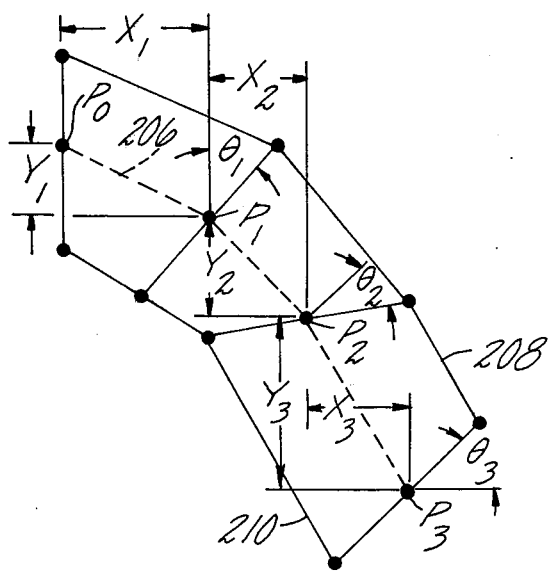
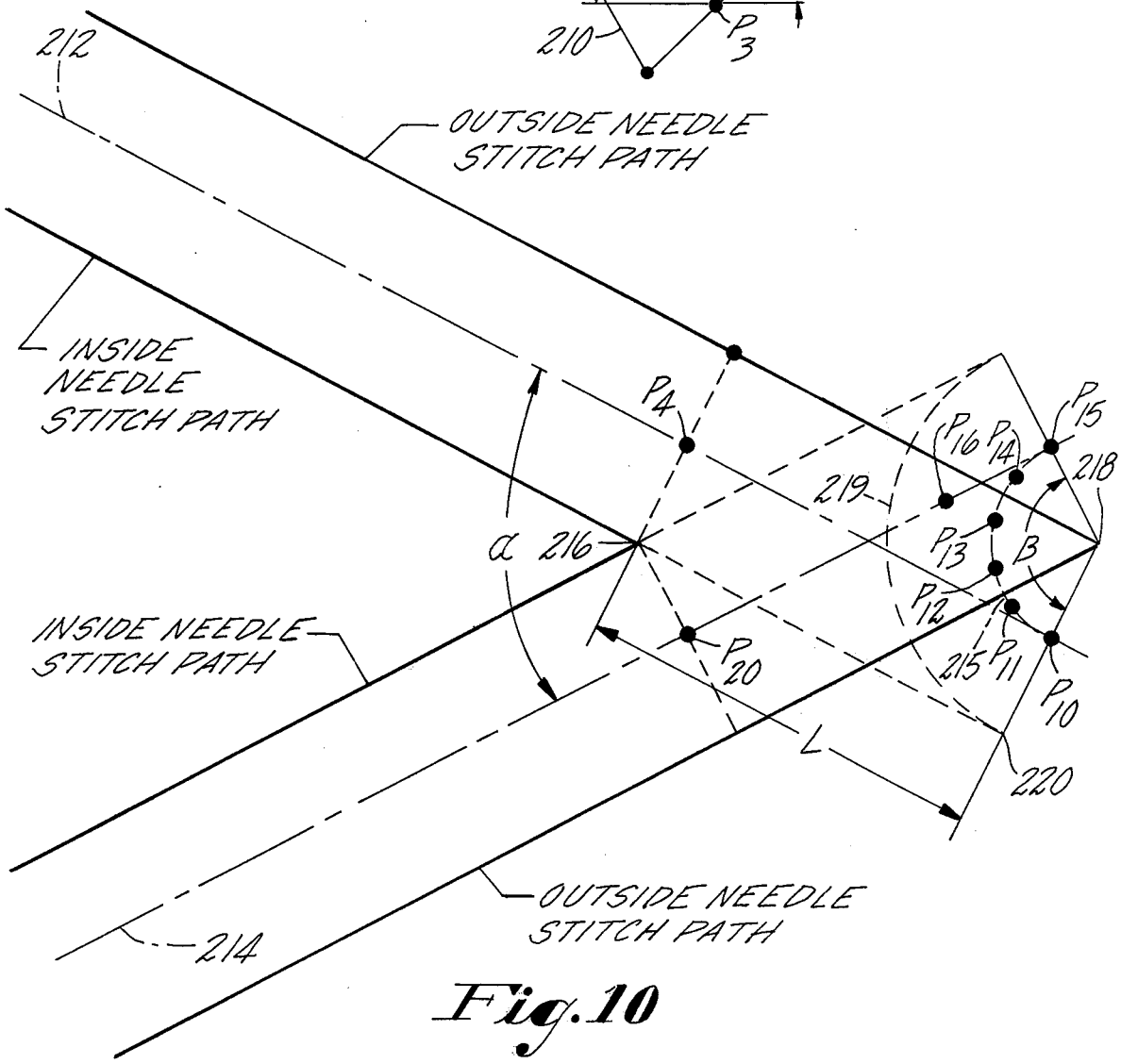
Fig. 10

METHOD AND MACHINE FOR VERSATILE STITCHING

This is a continuation of application Ser. No. 924,840, filed July 14, 1978, abandoned.

BACKGROUND OF THE INVENTION

This invention relates particularly to sewing machines, especially those incorporating automatic work guidance, but it will be understood that the invention could as well apply to other types of machines employing other tools, not necessarily needles.

When multi-needle sewing machines are employed on work relatively movable in a plane perpendicular to vertically reciprocable needles (or other tools) a component of work feeding movement along a line parallel to the line interconnecting the needle tips alters the spacing of each seam from the general sewing path and changes the spacing of one seam from an adjacent seam. This may produce unattractive results from the standpoints of appearance and structurally due to unequal stitch lengths. In order that the predetermined direction of movement of the workpiece at any moment be tangent with the stitch path, as often required for instance in lockstitch seams, zig-zag stitching, and chain stitch seams, it is necessary that the work, or the machine, or a portion of the latter, be relatively rotated about an operating axis. The present invention is in some embodiments directed to providing automatic relative rotation of the needle bar and hook or other stitch-forming assembly to maintain this desired tangency relation. In a broader aspect, the invention contemplates controlled rotation of a tool-carrying member about an axis normal to a plane in which the work is being predeterminedly advanced with X and/or Y components for processing, to maintain and/or predeterminedly change angular relation of the operating localities of a tool or tools carried by the member with respect to the path of movement of the work.

In U.S. Pat. No. 3,139,051, there is disclosed an arrangement in which the needle and bobbin assembly are not rotated, but a mechanism is provided for laterally shifting the workpiece relative to its direction of advance. U.S. Pat. No. 3,459,144 discloses a sewing machine wherein a workpiece is shiftable in X and Y directions to enable embroidery designs to be produced, an encoder supplies pulses to integrate X–Y table motion to work engagements of the stitching devices. These patents in the prior art, like all others in this category so far as known, do not rotate the needle and bobbin or other stitch-forming assembly about an axis, and hence lack the tangency or automatic angular control capability referred to above.

OBJECTS OF THE INVENTION

It is therefore an object of this invention to provide a method and machine for controlling the orientation of one or more operative tools relative to a moveable workpiece so as to thereby define one or more operating paths on the workpiece.

It is another object of this invention to provide a method and machine for controlling the orientation of one or more sewing instrumentalities relative to a moveable workpiece that is to be guided in its own plane.

It is still another object of this invention to provide a method and machine for controlling the space relationship between two sewing paths on a workpiece by rotating one or more sewing instrumentalities relative to the workpiece as the same is being progressively positioned with respect to the one or more sewing instrumentalities.

It is a still further object of this invention to predeterminedly control the successive orientation of at least two reciprocable sewing needles relative to a moveable workpiece so as to perform tangency and/or decorative stitching.

It is an even further object of this invention to provide a method and machine for causing threads associated with at least two needles to always exit from their respective eyes on the same side of the stitch path.

It is a still further object of this invention to provide a method and machine for executing discrete pullbacks of thread during the sewing of a pattern on a workpiece so as to thereby avoid momentary excess of thread.

SUMMARY OF THE INVENTION

The above and other objects are achieved according to the present invention by providing a sewing machine with one or more sewing instrumentalities that rotate relative to a workpiece that also moves. The sewing instrumentalities rotate about a common axis that is preferrably perpendicular to the plane of movement for the workpiece. The sewing instrumentalities in an illustrative embodiment, comprise dual reciprocable needles in combination with their respective hook assemblies. A tendency of the hook assemblies to locally rotate is counteracted during the overall rotation of the sewing instrumentalities.

The rotation of the sewing instrumentalities and the movement of the workpiece are effected by a mechanical drive system in combination with a digital control system. The digital control system is operative to successively command a number of predefined rotations of the sewing instrumentalities in conjunction with a number of pre-defined movements of the workpiece. The controlled rotation of the sewing instrumentalities in combination with the progressive movement of the workpiece produces a number of desirable sewing effects including that of tangency stitching.

The invention furthermore provides for separate and independent control of each sewing instrumentality so as to thereby render one or both needles inoperative at pre-determined localities during continuous operation of the machine. The invention still further provides for the separate manipulation of thread associated with each sewing instrumentality so as to allow for discrete pullbacks of this thread.

In principle, the invention is also applicable to other than sewing machines where one or more operative tools may, for example, perform such functions as marking, folding, pinking or perforating.

BRIEF DESCRIPTION OF THE DRAWINGS

The foregoing and other features of the invention, together with various novel details and combinations of parts, will now be more particularly described in connection with an illustrative machine in which they are embodied and with reference to the accompanying drawings thereof, in which:

FIG. 9 is a two needle stitching pattern illustrating various manipulative control features.

FIG. 10 is another two needle stitching pattern illustrating further manipulative control features.

DESCRIPTION OF THE PREFERRED EMBODIMENT

Figure 1:
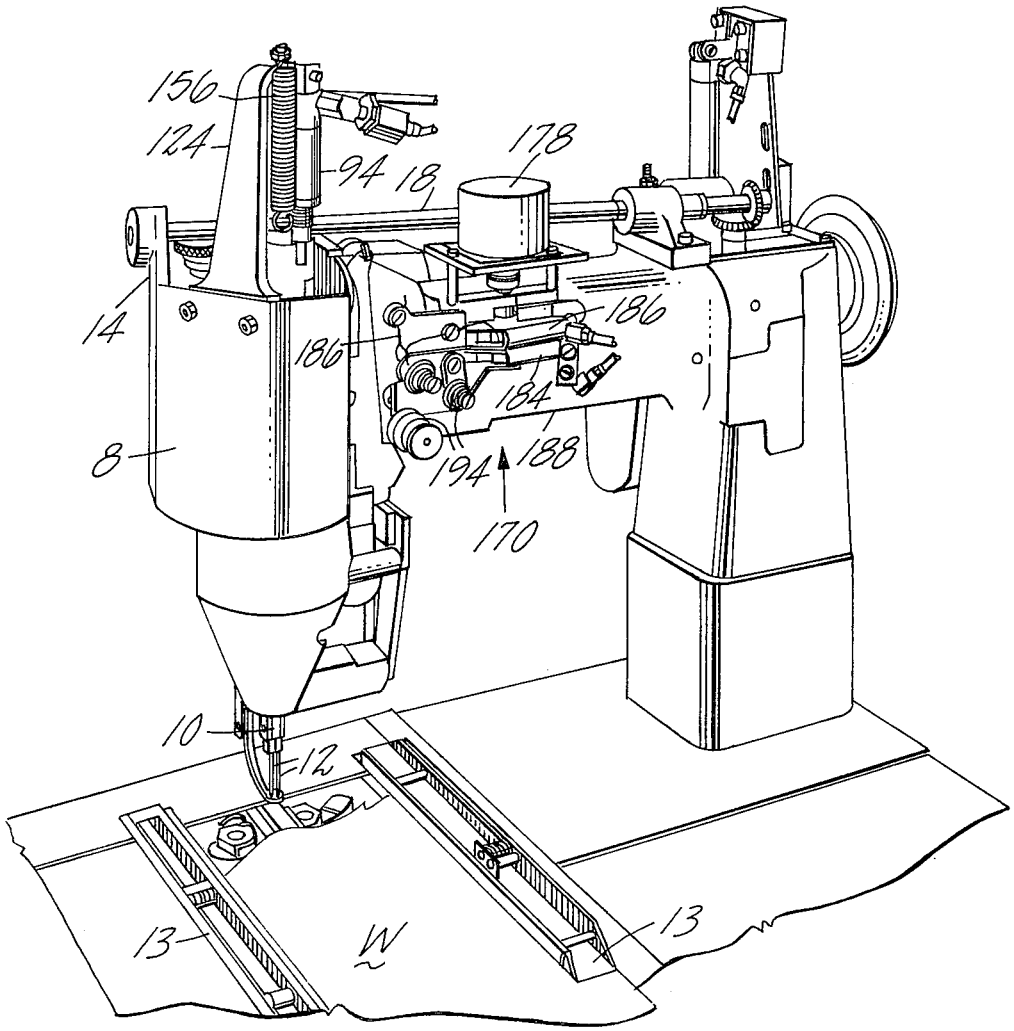
FIG. 1 is a perspective view of a lockstitch sewing machine for performing automatically controlled plain and/or fancy stitching, a two-needle arrangement being selected for purposes of the illustration, and the electrical controls being omitted.
Figure 2:
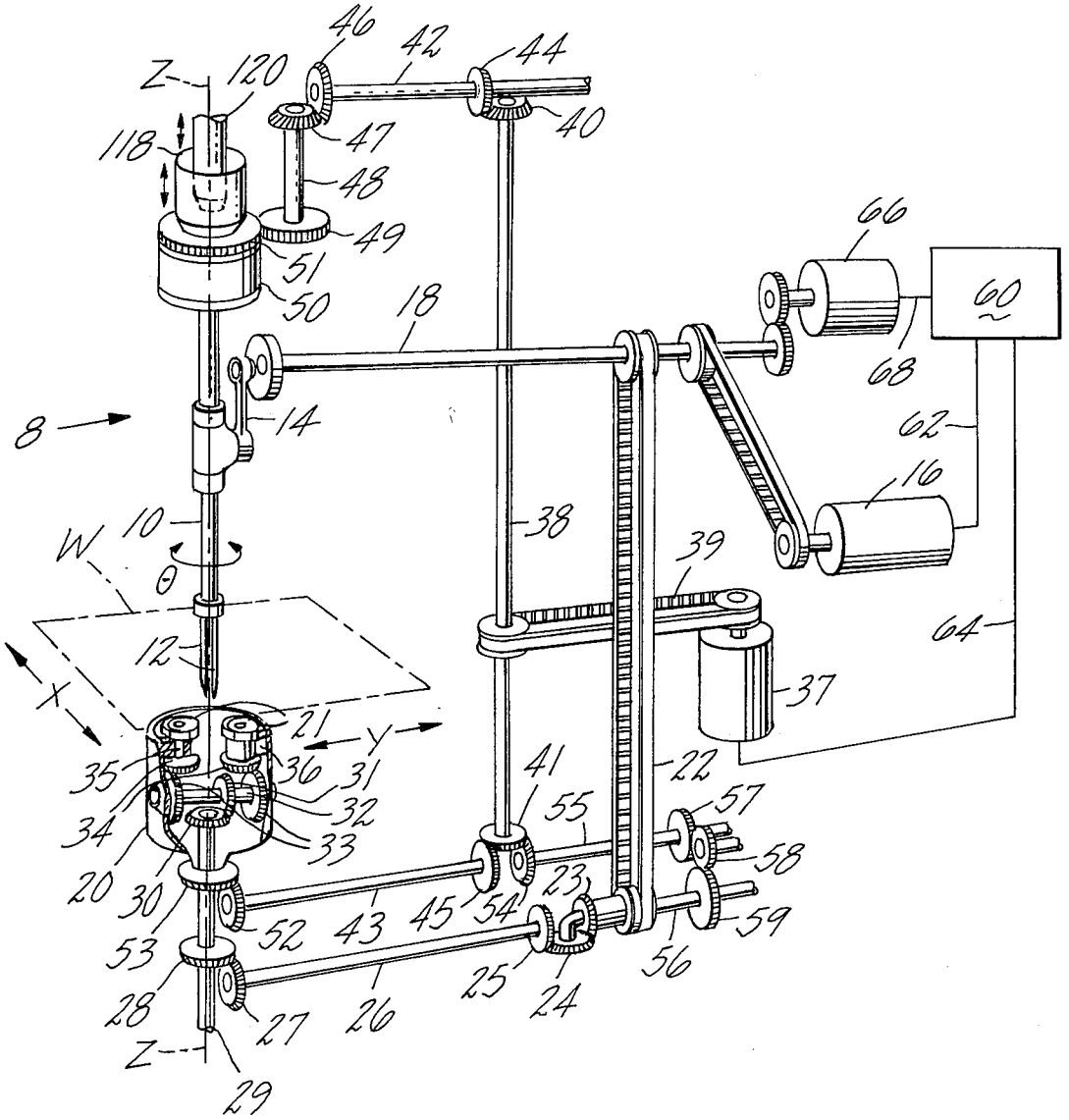
FIG. 2 is a diagrammatic perspective view of a mechanism in the machine of FIG. 1 for rotating a needle bar and bobbin-hook assembly when the needles are disengaged from work carried by a table automatically guided for X–Y motion.

Referring mainly to FIG. 1 and the schematic diagram of FIG. 2, a lockstitch machine comprises a stationary head 8 housing a composite needle bar 10 (FIGS. 2–3) in this instance supporting a pair of parallel needles 12,12, one on each side of a vertical axis Z—Z of the needle bar. A workpiece W is preferably moved in a plane normal to the needles 12,12 by any number of conventional X—Y positioning systems well known in the art. The workpiece is held between a pair of conventional clamps 13,13 when being thus moved. The bar is driven reciprocably toward and from the planar workpiece W by means of a crank 14, a main motor 16, and a shaft 18 operatively connecting the crank and the motor. As shown, the offset of each needle from the Z—Z axis is substantially though not necessarily the same. As shown schematically in FIG. 2, the needles reciprocate vertically and parallel to the needle bar axis Z—Z, mainly on the upper side of the workpiece W.

The sewing instrumentalities further comprise an under-work stitch-forming assembly within a housing 20 on the opposite or underside of the work. The stitch-forming assembly contains a pair of hooking devices 21,21, which perform a coordinated thread-hooking function with respect to the needles 12 when the same have move through the workpiece W. It is to be appreciated that various other types of stitch-forming devices might be used within the housing 20. These stitch-forming devices might comprise single or double hook types, a chain looper type, or shuttle type, all of which are known in the art.

The hooking devices 21 move in synchronization with the up and down movement of the needles 12, for instance as will now be described. A drive belt 22 operates off of the shaft 18 and rotates a gear 23 which in turn meshes with a gear 24. The gear 24 in turn meshes with a gear 25 at one end of a shaft 26. A gear 27 at the other end of the shaft 26 meshes with a gear 28 affixed to a vertical shaft 29. It is to be appreciated that a rotation of the gear 23 by the drive belt 22 will result in a rotation of the vertical shaft 29 about the Z—Z axis. The shaft 29 differentially rotates relative to the housing 20. A gear 30 mounted at the top of the shaft 29 is operative to transmit the rotational motion of the shaft 29 to a gear 31. The gear 31 is affixed to a horizontal shaft 32 rotatably journalled in the housing 20. A pair of gears 33,33 affixed to the shaft 32, are operative to transmit the rotary motion of the shaft 32 to a pair of gears 34,34. The gears 34 are affixed to the ends of vertical stub shafts such as 35 which are in turn each affixed to the hooking devices 21. The stub shafts 35 are rotatively mounted within support arms such as 36 which form part of the housing 20. It is to be appreciated that the hooking devices 21 will rotate about their respective axes through the stub shafts 35 in response to a rotational motion of the horizontal shaft 32 which is itself dependent on the rotation of the shaft 29. The amount of rotation about the Z—Z axis is sufficient to implement a thread-hooking function by the devices 21.

In accordance with the invention, the sewing instrumentalities above the work are also rotated about the Z—Z axis. In this regard, a motor 37 (FIG. 2) is operative to rotate a shaft 38 via a drive belt 39. The amount and timing of the rotational drive imparted to the shaft 38 by the motor 37 is governed by a control system which will be explained in detail hereinafter. At present it is merely to be noted that the amount of rotational drive which is thereby imparted will ultimately cause the sewing instrumentalities to rotate a prescribed variable amount herein designated $\theta$, about the Z—Z axis. The timing of the rotational drive will occur when the needles 12,12 are out of the workpiece.

A pair of gears 40 and 41, mounted at opposite ends of the shaft 38, transmit rotary motion to a pair of shafts 42 and 43 respectively via a pair of gears 44 and 45. Considering the shaft 42 first, it is seen that a gear 46 mounted at the end thereof meshes with a gear 47 so as to thereby rotate a shaft 48. A gear 49 mounted at the other end of the shaft 48 transmits rotary motion to a member 50 by meshing with a spline gear 51 formed thereon. The member 50 is journalled in the head 8 of the sewing machine of FIG. 1. The member 50, being connected as subsequently described, imparts rotational motion to the needle bar 10. It follows that the needles 12,12 carried by the needle bar 10 will thereby rotate the prescribed angular amount $\theta$. Referring again to the shaft 43, it is seen that a gear 52 mounted at the end thereof meshes with a gear 53 affixed to the housing 20. The gear 53 is affixed to the exterior of the housing 20 so as to thereby rotate the housing about the Z—Z axis in the amount $\theta$ prescribed by the rotation of the shaft 43. It is to be appreciated that the hooking devices 21 which are mounted to the housing 20 via the support arms 35 will also bodily move the prescribed angular amount.

It is to be noted that the hooking devices 21 will also rotate about their respective stub shaft axes during the rotation of the housing 20. This is caused by the shaft 32 being journalled in the housing 20. The angular movement of the housing 20 about the Z—Z axis causes the horizontal shaft 32 to also move the same amount. This will in turn cause rotational movement of the shaft 32 about its own axis so as to thereby impart rotational motion to the gears 34 and hence the hooking devices 21. This rotational motion of the hooking devices 21 about their respective stub shaft axes is known as an epicyclic effect caused by the angular movement of the housing 20. To insure hooking of needle thread regardless of the $\theta$-positions of the needles, the epicyclic movement of the hook assemblies 21 is corrected in the manner hereinafter described, it being understood alternative "corrective" arrangements may also be employed when desired.

Referring to the gear 41 at the end of the shaft 38, it is seen that this gear meshes with a gear 54 at the end of a shaft 55. The rotation of the shaft 55 is imparted to a differential shaft 56 via gears 57, 58 and 59. The shaft 56 is freely rotatable in the bore of the gear 23. The gear 24 which is attached to the end of the differential shaft 56 meshes with the gear 25 so as to thereby rotate the shaft 26. As has been previously described, the rotation of the shaft 26 imparts a rotation to the shaft 29 which in turn imparts a rotation to the shaft 32. The amount of rotation imparted to the shaft 32 is such as to rotate the hooking devices 21 about their respective stub shaft axes so as to thereby correct for the aforementioned epicyclic movement of these same devices.

It is to be noted that the motors 16 and 37 are connected to a control system 60 in FIG. 2 via a pair of lines 62 and 64. The control system 60 is furthermore connected to a needle position sensor 66 via a line 68. The control system 60 (FIGS. 2 and 11) is operative to control the motors 16 and 37 so as to thereby rotate the sewing instrumentalities when the needles are disengaged from the workpiece W. This will be fully explained in detail hereinafter.

Figure 3:
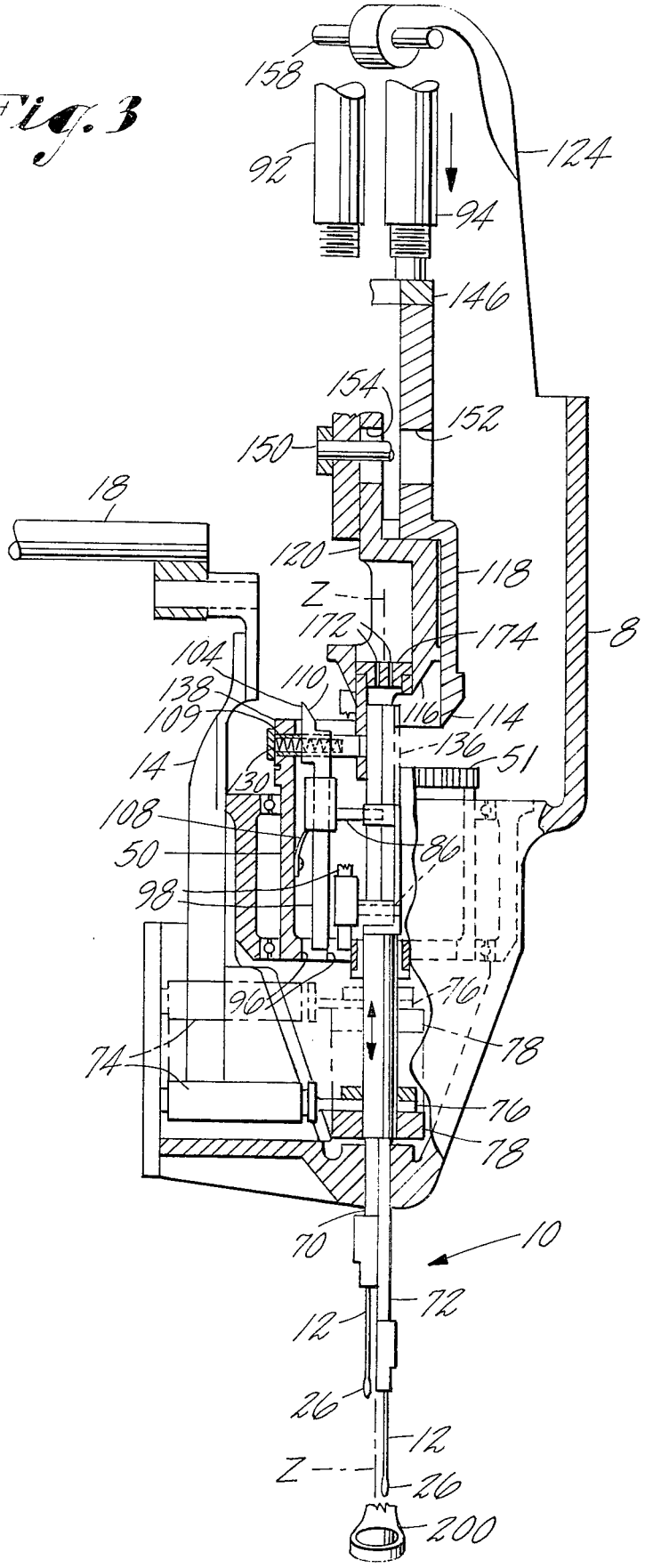
FIG. 3 is an enlarged view in side elevation, of the sewing head shown in FIGS. 1 and 3, portions being broken away to reveal internal structure, and showing only one of the needles operative.
Figure 4:
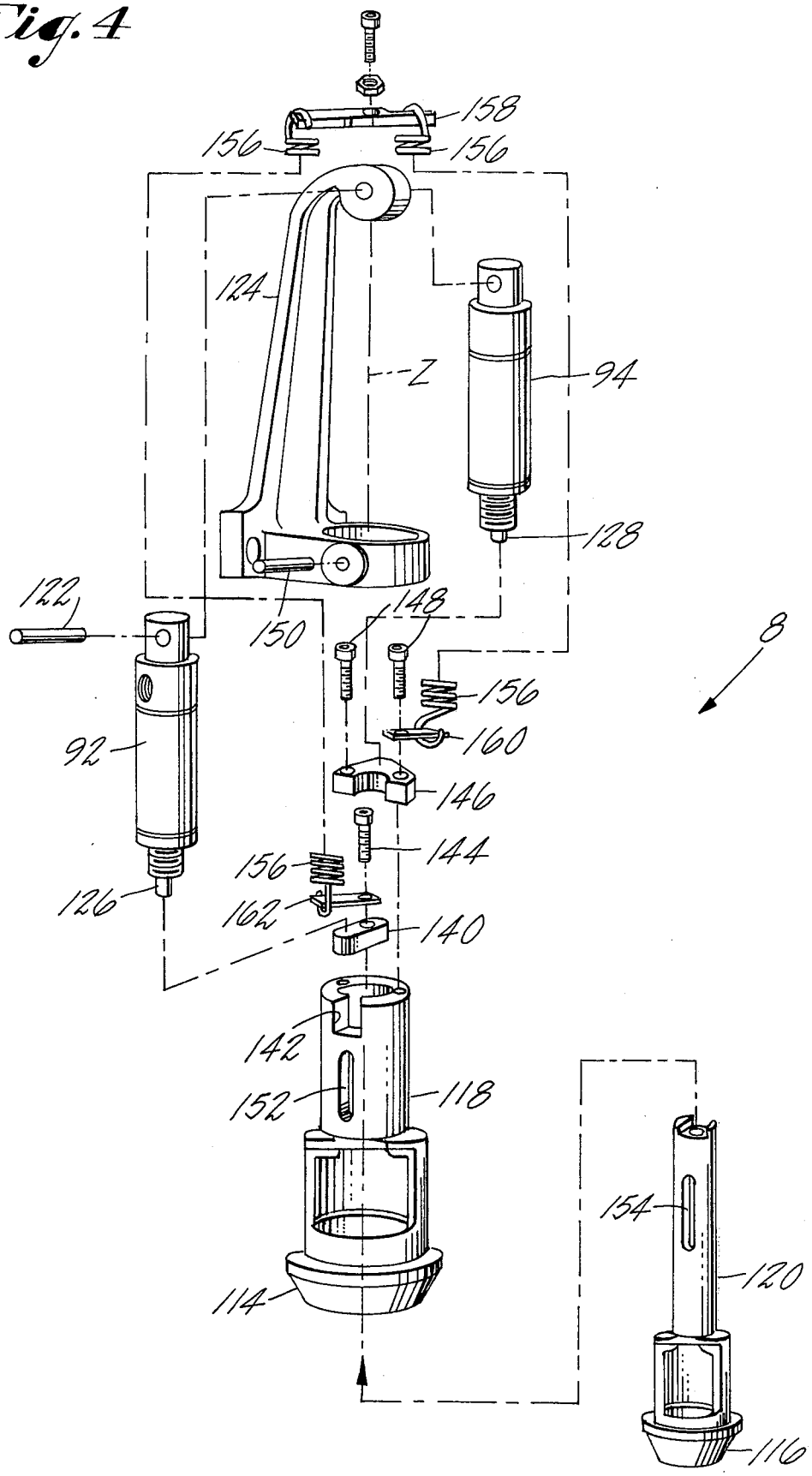
FIGS. 4 and 4*a* are, respectively, upper and lower sections of the sewing head shown in exploded perspective.
Figure 4A:
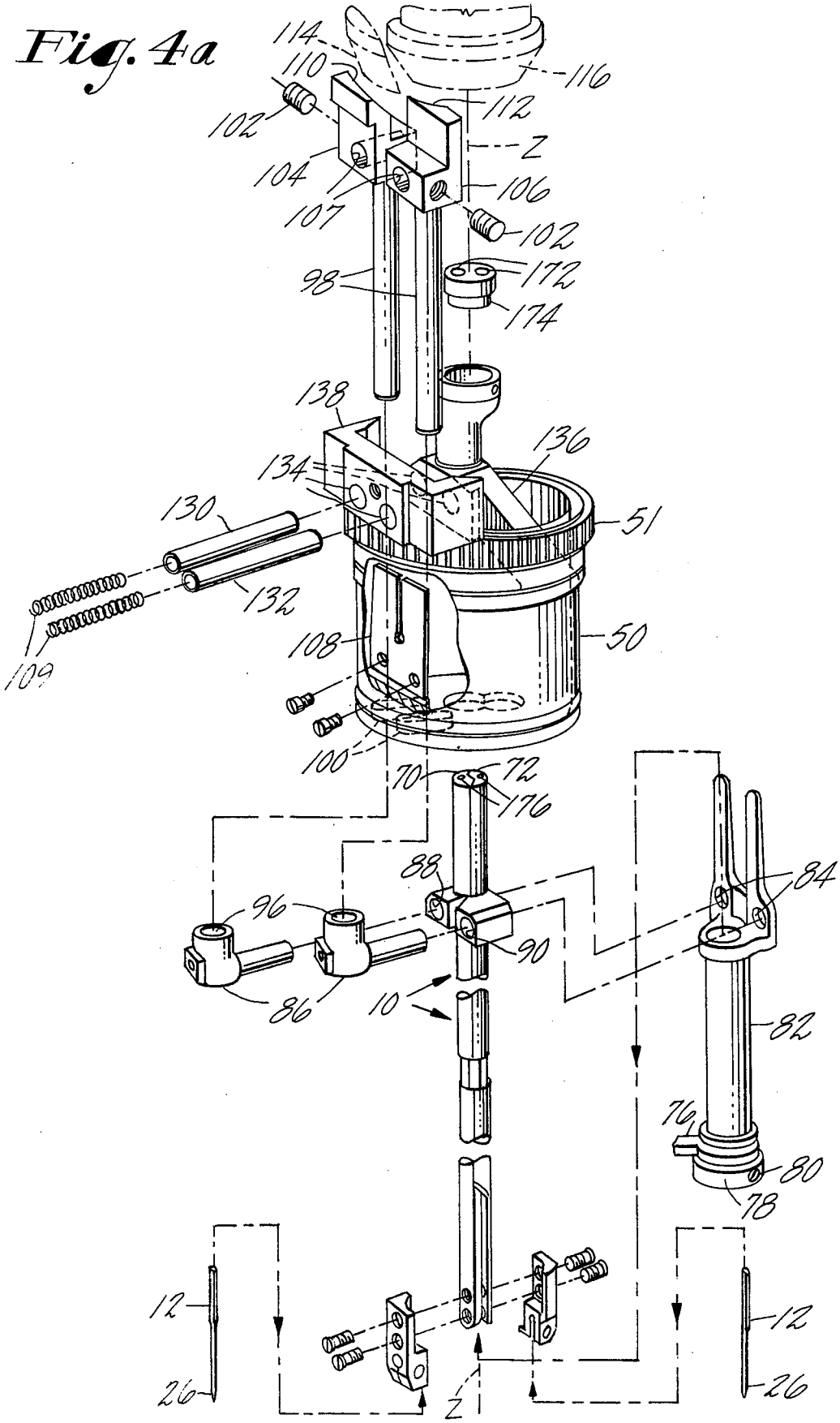
Figure 5:
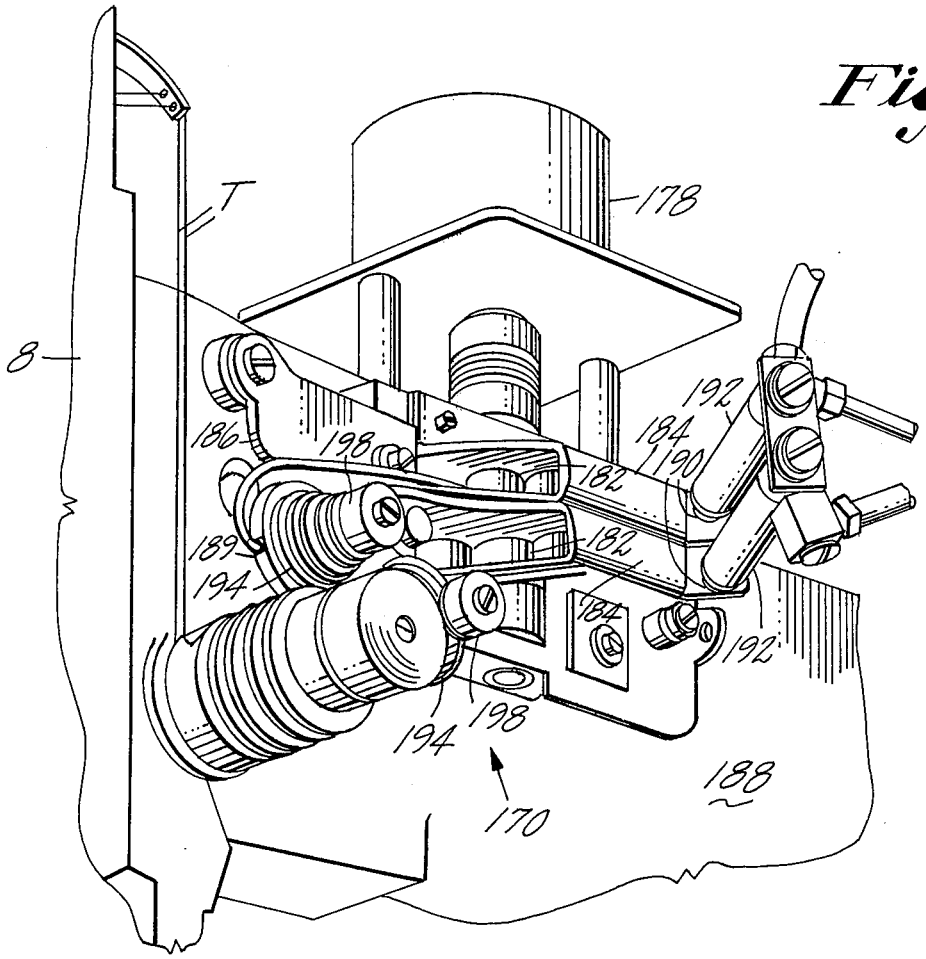
FIG. 5 is an enlarged perspective of upper and lower thread control mechanism seen in FIG. 1.
Figure 6:
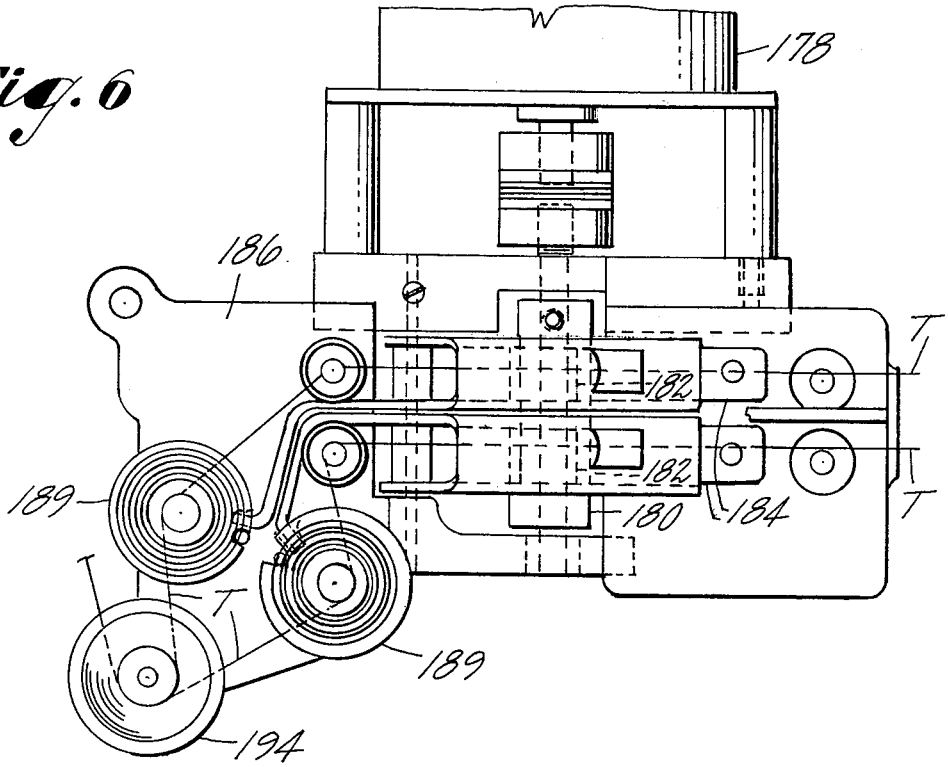
FIG. 6 is a view in side elevation of the mechanism shown in FIG. 5, with a portion of the actuating means broken away.
Figure 7:
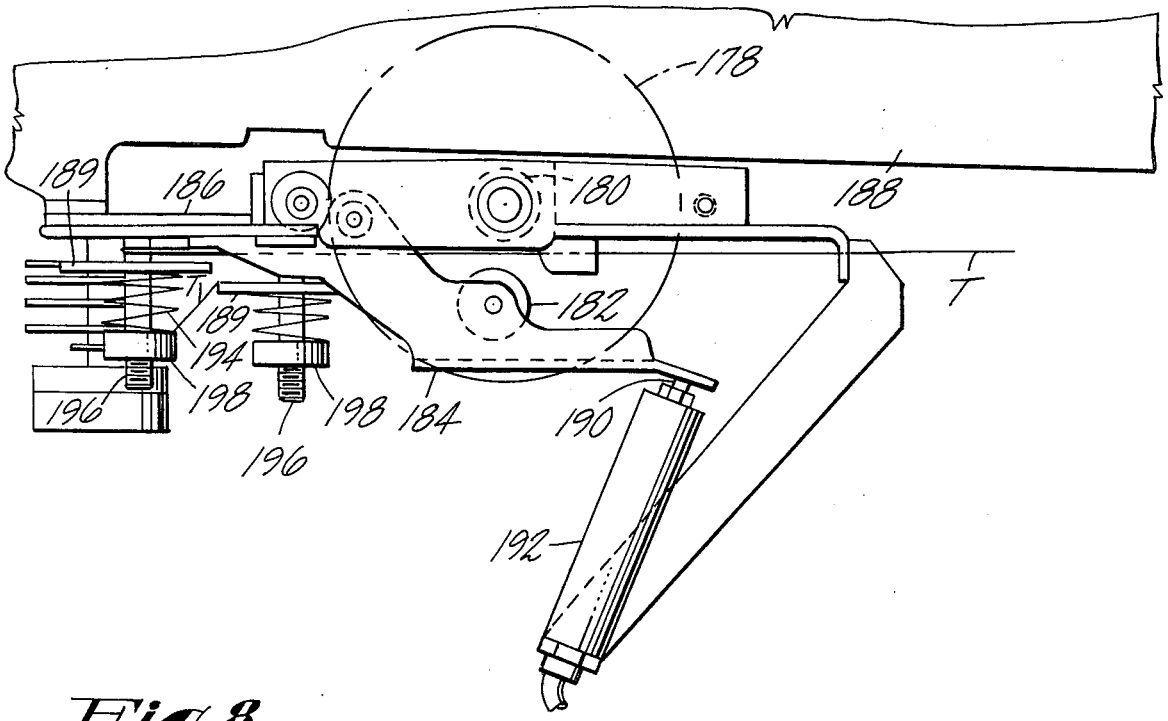
FIG. 7 is a plan view of one of the thread control mechanisms in its inoperative condition.

Turning now more particularly to FIGS. 3, 4, and 4*a* it is seen that these figures are directed to the operating mechanism within the head 8. For purposes hereinafter explained, the composite bar 10 comprises longitudinally matching rods 70,72, respectively adapted to reciprocate one of the two needles 12. Hence, as will be seen, predeterminedly either one may in the course of sewing, individually, in unison, or alternately, be reciprocated. The crank 14 carries a vertically guided connecting rod 74 having an annular wrist pin 76 which is received in a groove of a lifting rotatable collar 78 (FIGS. 3, 4*a*) affixed by a set screw 80 to a partly tubular member 82. The latter is accordingly continuously vertically reciprocable and is also at times, rotatable about the Z-axis is hereinafter to be described.

The tubular portion of the member 82 axially and slidably receives the lower ends of the needle bars 70,72. An upper forked end of the member 82 is formed with spaced holes 84,84 for removably receiving ends of socket pins 86,86 respectively, which extend transversely, one through a bore 88 in the bar 70 and the other through a bore 90 in the bar 72. As will be explained hereinafter, these socket pins 86,86, have a driving connection to both the splined member 50 and the dual acting air motors 92,94 (FIGS. 3,4). It will be remembered that the member 50 is rotated in various prescribed amounts designated $\theta$. The air motors enable or disable vertical reciprocation of either of the needles 12, as will next be described. Particular note is to be taken that these needle motions can be effected in the course of continued operation of the machine.

First consider the driving connection to the member 50 which facilitates the $\theta$ rotation of the needles. Each of the pins 86 has a socket 96 for receiving the lower ends of vertical rods 98 (FIG. 4*a*) respectively. The rods 98 extend through elongated radial slots 100,100 respectively formed in the base of the member 50. The rods 98 and the slots 100 hence form the driving connection between the socket pins 86 and the member 50. Upper ends of the rods 98 are secured, respectively, by set screws 102 to blocks 104, 106, hereinafter further referred to. A forked spring clip 108 bears on members 104,106 to hold the needle bar assembly up when the pins 86 are disengaged from the holes 84. Springs 109 (FIGS. 3,4*a*) secured to the inside of the head 8 urge the rods 98 toward radially inner ends of their slots 100. Thus the socket pins 86 are caused to turn the needle bars 70, 72 any angle $\theta$ by reason of the rods 98, 98 being engaged by the sides of the slots 100,100 when the member 50 is rotated about the $\theta$-axis.

Means for automatically enabling or disabling vertical reciprocation of the needles will now be described mainly with reference to FIGS. 4 and 4*a*. The blocks 104,106 respectively have radilly spaced conical faces 110,112 engageable by correspondingly conical outer and inner faces 114, 116 formed respectively on coaxial tubular plunger members 118,120 (FIG. 4). The air motors 92,94 are mounted on a cross pin 122 in the upper end of a bracket 124 (FIGS. 1 and 4) affixed to the head 8. As will be explained, for any $\theta$-angle (about the Z-axis) of the rods 98 and their blocks 104,106, heightwise movement of the members 118,120 (or either of them) by vertical operation of piston rods 126,128 respectively, causes radial movement of one or both of the rods 98 and axial movement of the pins 86 in their bores 88,90, and hence makes or breaks operative engagement of the pins 86 (or either of them) with walls of the holes 84. This is because the blocks 104,106 have holes 107 and are axially slidable (when displaced by the conical surfaces) on bearing pins 130,132 therein (FIG. 4*a*). The pins 130,132 are radially disposed and have their ends received in bores 134 formed in a bridge portion 136 of the member 24 and in a block 138 secured on the member 24.

Referring to FIG. 4 again the piston rod 126 acts to lower the inner plunger 120 by abutting the upper surface of a block 140 slidably fitted in a slot 142 formed in the outer plunger 118, the block 140 being secured to the plunger 120 by a screw 144. Similarly, the piston rod 128 is arranged to independently lower the outer plunger 118 by abutting a piece 146 secured to the top of the plunger 118 by screws 148,148. A guide pin 150 (FIGS. 3,4) extends through the bracket 124 and aligned slots 152,154 in the plungers 188,120 respectively. Lowering of either of the conical plungers thus to prevent operation of either of the needles 12 is effected against resistance of one of a pair of return springs 156,156 (FIGS. 1,4*a*). The springs 156 are suspended from a support 158 affixed to the top of the bracket 124. A lower end of one of the springs 156 is connected to a tab 160 secured to the piece 146, and a lower end of the other spring 156 is secured to a tab 162 attached to the block 140.

Figure 8:
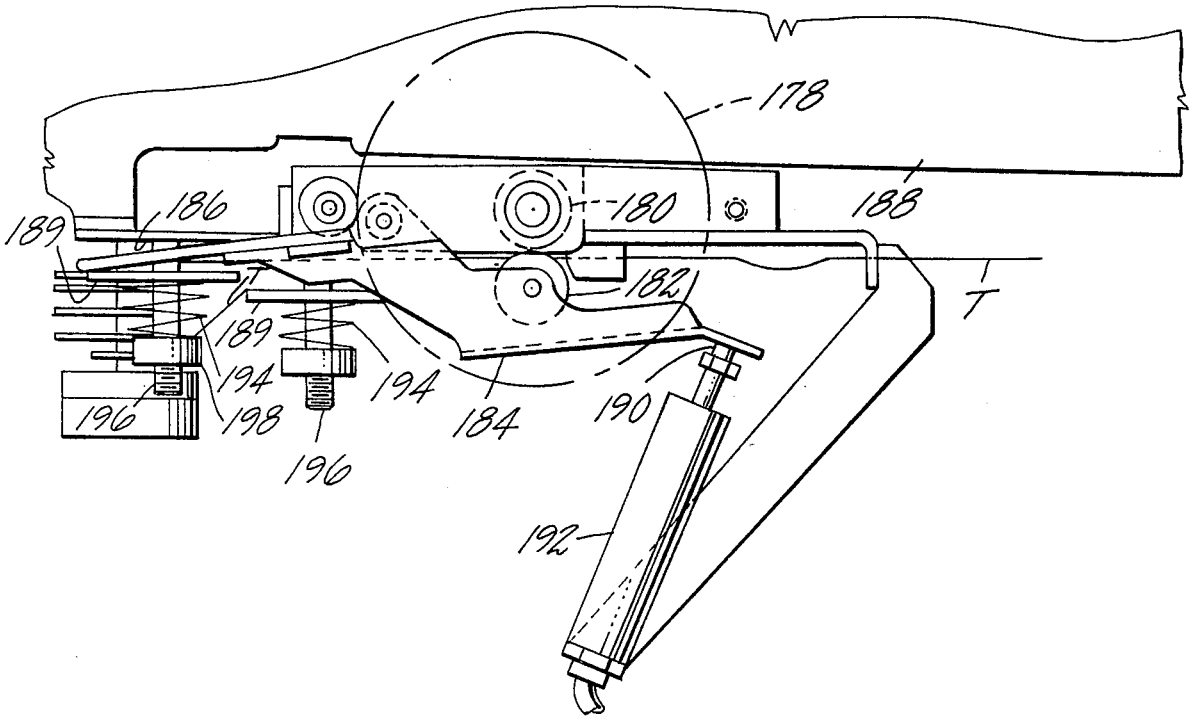
FIG. 8 is a view similar to FIG. 7 except that the mechanism is shown actuated.

Thread T, T (FIGS. 1, 5–8) is supplied from spools (not shown) to the needles 12,12 via a thread take-up and pull-back means generally designated 170,170 and extends downwardly through vertical bores 172,172 in a plug 174 (FIGS. 3,*4a*) mounted on the bridge portion 136. From there the thread extends downwardly to the needles through axial holes 176,176 (FIG. *4a*) formed in the respective bars 70,72. In order to eliminate the excess of thread T incurred when it is pulled from either of the needles 12 upon a needle disenagement as above described, the appropriate one of the means 170 is operable as will next be explained. A thread pull-back or "push-pull" stepper motor 178 (FIGS. 5–9) mounted on a main frame 188, when energized, rotates (counterclockwise as seen in FIG. 8) a friction roll 180 cooperative with one or both of a pair of axially spaced idler rollers 182,182 carried, respectively, by upper and lower levers 184,184 pivotally mounted on a bracket 186 on the side of the main frame 188 of the machine. Each of the levers 184 engages at one end an adjustable thread-engaging friction means 189 and has its opposite end arranged to be engaged by one of a pair of piston rods 190 respectively actuated by spring return air motors 192,192. The thread T passes between the bracket and the means 189 with compression springs 194 compressed as indicated in FIG. 8, the springs being adjustably confined on screws 196 projecting from the bracket 186 by nuts 198, respectively.

The air motors 192, 192 as well as the stepping motor 178 are electrically connected to the control system 60 that has been previously discussed with regard to FIG. 2. This control system will be described in detail hereinafter. It is merely to be noted at this time that either of the motors 192 can be independently activated by the control system. The air motor that is thereby activated will cause its respective idler roller 182 to move thread associated therewith against the friction roll 180. The stepping motor 178 will rotate the friction roll 180 a prescribed amount dictated by the control system 60. This will cause the thread that has been moved into contact with the friction roll 180 to be retracted by a prescribed amount. It is to be understood that the control system 60 may implement one or more successive pullbacks of thread. This will be further explained with regard to a particular example of thread pullback hereinafter.

For present purposes it may be assumed that the supply of bobbin thread is effected by known mechanism. Also, it will be understood that although not herein disclosed the machine further comprises suitable automatic under-bed, thread cutting mechanism, preferably of the guillotine type, which can cut either of the two bobbin threads alone, either of the two sets of top and bobbin threads, or both top and bobbin threads simultaneously. It will further be understood, that at times the motor 178 reverses rotation in order to release tension in either or both threads T prior to their being snipped. A presser foot 200 (FIGS. 1, 3) is formed with a hole large enough to encircle both of the needles and may be actuated heightwise by conventional means in time relation to work engagements of the needles or needle.

Turning now to FIG. 9, an example of a two-needle stitching pattern that is to be sewn under the control of the X, Y and $\theta$ drives is illustrated. The stitching pattern comprises a dotted center-line path 206 which traces the successive positions of the pattern relative to the Z-axis of rotation of FIG. 2. It is to be noted that each successive relative position of the pattern is defined by an X and a Y movement of the pattern. In this regard, a position $P_0$ is arbitrarily defined as the initial position of the pattern relative to the Z-axis of rotation. An $X_1$ and a $Y_1$ define the first successive position $P_1$ of the pattern relative to the Z-axis of rotation. As can be appreciated, an $X_n$ and a $Y_n$ define the nth successive position of the pattern relative to the Z-axis of rotation. The angular rotation of the needles about the Z-axis of rotation at the initial position $P_0$ is defined as $\theta_0$. This initial angular rotation is zero degrees in FIG. 9. The amount of angular rotation of the needles about the axis of rotation is a $\theta_1$ when the position $P_1$ is reached. In a similar manner, the amount of relative rotation is $\theta_n$ when moving from the $P_{n-1}$ position to the $P_n$ position. In other words, the two needles are merely located outwardly from the Z-axis of rotation and are hence positioned by the $\theta$ displacements about the Z-axis of rotation. It is seen that the two needles are jointly activated after each successive positioning of the pattern relative to the Z-axis of rotation in FIG. 9. In this manner a set of stitching paths 208 and 210 are defined wherein each path comprises a plurality of successive stitching points.

Turning now to FIG. 10, another exemplary two needle stitching pattern is illustrated. The two needle stitching pattern of FIG. 10 illustrates how a corner pattern is to be executed. The corner pattern comprises inner and outer stitching paths indicated as bold solid lines. The paths are themselves defined by successively positioning the Z-axis of rotation along a pair of dotted straight-line centerline paths 212 and 214 plus a circular centerline path 215. The position $P_4$, located on the centerline 212, marks the last position wherein both needles engage the workpiece and form stitches. The position $P_4$ moreover defines the inside needle stitch point 216 which constitutes the apex of the inner corner. The outside needle continues to stitch at each successive relative position of the Z-axis of rotation along the centerline path 212 up to and including a position $P_{10}$ of the Z-axis of rotation. The position $P_{10}$ defines an outside needle stitch point 218 which constitutes the apex of the outer corner. At this position, the path of movement of the Z-axis of rotation changes from straight to substantially circular as is indicated by the centerline path 215. This allows the inside needle to pivot about the outside needle point 218 in a substantially circular arc 219. This pivotal motion about the outside needle point 218 assures that the outside needle will not have any appreciable thread pulled therethrough. The amount of angular rotation, $\beta$, of the inside needle about the point 218 is equal to $180°-\alpha$ wherein $\alpha$ equals the corner angle that is to be executed. It is to be noted that in implementing the angular rotation of the inside needle about the point 218, it is necessary to define a series of finite X and Y movements of the Z-axis in conjunction with $\theta$ rotations. This can be accomplished by arbitrarily defining a number of $P_i$ positions along the centerline path 215. The number of successive positions $P_i$ of the Z-axis of rotation is somewhat arbitrary. For the purpose of illustration, the Z-axis of rotation moves through successive positions $P_{11}$, $P_{12}$, $P_{13}$, $P_{14}$ and $P_{15}$. Each $P_i$ position is defined by a set of $X_i$ and $Y_i$ movements relative to the previous $P_i$ position. These $X_i$ and $Y_i$ movements will also cause the outside needle to move away from the stitch point 218 unless compensated by an appropriate $\theta_i$ rotation. The amount of $\theta_i$ rotation is obtained by noting how much the needle bar must be rotated at the new position so as to again bring the outside needle back over the stitch point 218. The process of incrementally moving the Z-axis of rotation by $X_i$ and $Y_i$ amounts and thereafter rotating the needlebar about the new position so as to again align the outside needle can be hand plotted for positions $P_{11}$ through $P_{15}$. As will become apparent hereinafter, the thus determined X, Y, and $\theta$ movements will be sequentially implemented by automatic control. It is to be noted that both needles will remain disengaged from positions $P_{11}$ to position $P_{15}$. The outside needle is activated at the next position $P_{16}$ and continues to be the only activated needle down to and including position $P_{20}$.

It is to be noted that the inside needle has remained inactive from the position $P_4$ of the Z-axis on the centerline 212 through to and including the position $P_{20}$ of the Z-axis on the centerline 214. During this time, the thread has been drawn through the inside needle as the workpiece has been successively positioned relative to the Z-axis of rotation. Specifically, the thread has been pulled through the inside needle from positions $P_4$ to $P_{10}$ of the Z-axis of rotation. The position $P_4$ corresponds to the position 216 of the inside needle wherein thread is first pulled through the needle without a stitch being sewn. The position $P_{10}$ corresponds to the maximum thread pull position 220 of the inside needle. The distance "L", between the points 216 and 220 equals the amount of thread pulled through the inside needle when it moves from position $P_4$ to position $P_{15}$. This length of thread "L" represents excess thread which is to be pulled back during the subsequent movement of the pattern relative to the Z-axis of rotation from positions $P_{15}$ to $P_{20}$. This movement allows for five incremental pull backs of the excess thread through the inside needle. Each incremental pullback of thread occurs during an incremental X and Y movement of the workpieces. For purposes of future reference, each incremental pullback will be designated as a $\phi$. Each incremental pullback $\phi$ is preferably set equal to the distance "L" divided by the number of successive positions of the Z-axis of rotation occurring after its first position along the centerline 214 up to and including its last position wherein only the outside needle is activated for stitching. It is to be appreciated that both needles will be activated for successive positions of the pattern relative to the Z-axis of rotation after the position $P_{20}$. The thread tension will have been appropriately maintained for the subsequent activation of the inside needle by virtue of the aforementioned pull back.

From the above, it will be appreciated that a set of four parameters are necessary to implement dual needle stitching. These parameters are: X, Y, $\theta$, and $\phi$. In addition to these parameters, an indication of engagement/disengagement for each needle plus an indication of an "end of pattern" is also necessary.

Figure 11:
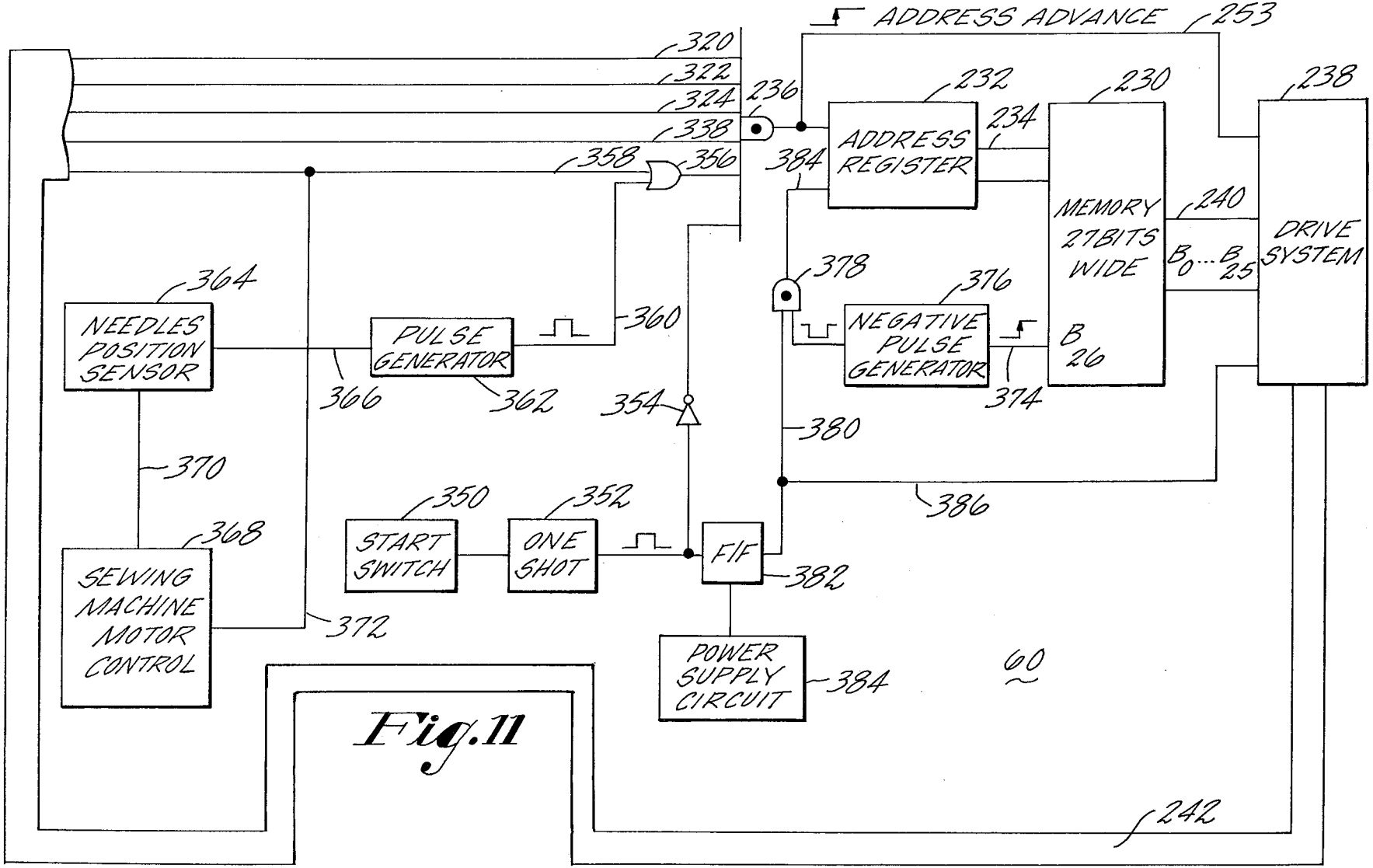
FIG. 11 illustrates the digital control system which implements the aforementioned manipulative control features.

Turning to FIG. 11, a numerical control system responsive to the aforementioned parameters is illustrated. This numerical control system has been previously broadly referred to as control system 60 in FIG. 2. The numerical control system 60 comprises a memory 230 having addressable storage locations which are twenty-seven bits wide. The bits $B_0$–$B_{26}$ within an addressable storage location are organized as follows:

$B_0$–$B_5$—magnitude of X movement
$B_6$—direction of X movement
$B_7$–$B_{12}$–magnitude of Y movement
$B_{13}$—direction of Y movement
$B_{14}$–$B_{18}$—magnitude of $\theta$ movement
$B_{19}$—clockwise or counterclockwise direction of $\theta$ movement.
$B_{20}$–$B_{22}$—push/pull of thread magnitude of $\phi$ movement.
$B_{23}$—direction of $\phi$ movement
$B_{24}$—engage/disengage inner needle
$B_{25}$—engage/disengage outer needle 2
$B_{26}$—end of pattern Each addressable storage location in the memory 230 is particularly addressed by an address register 232 which is interconnected with the memory through an address bus 234. The address register 232 is preferably a ten bit register capable of addressing at least one thousand individual storage locations in the memory 230. Each storage location contains one twenty-seven bit work of information defining a prescribed set of movements as has been previously discussed The ten bit address in the register 232 is advanced in response to a change in state of an AND gate 236. The change in state of the AND gate 236 is premised on a plurality of signal conditions being present at its input. These signal conditions will be described in detail hereinafter. For the moment, it is merely to be noted that the output of the AND gate 236 will switch from a logically low to a logically high signal state when the address is to be advanced. This "address advance" signal is operative to increment the address register 232 which in turn addresses the next twenty-seven bit storage location in the memory 230.

The bits $B_0$—$B_{25}$ of the particularly addressed storage location are applied to a drive system 238 via a twenty-six bit bus 240. The drive system 238 executes the prescribed movements dictated by the twenty-six bits and signals when the same has been accomplished. This latter signalling is applied to the input side of the AND gate 236 via a bus 242.

Figure 12:
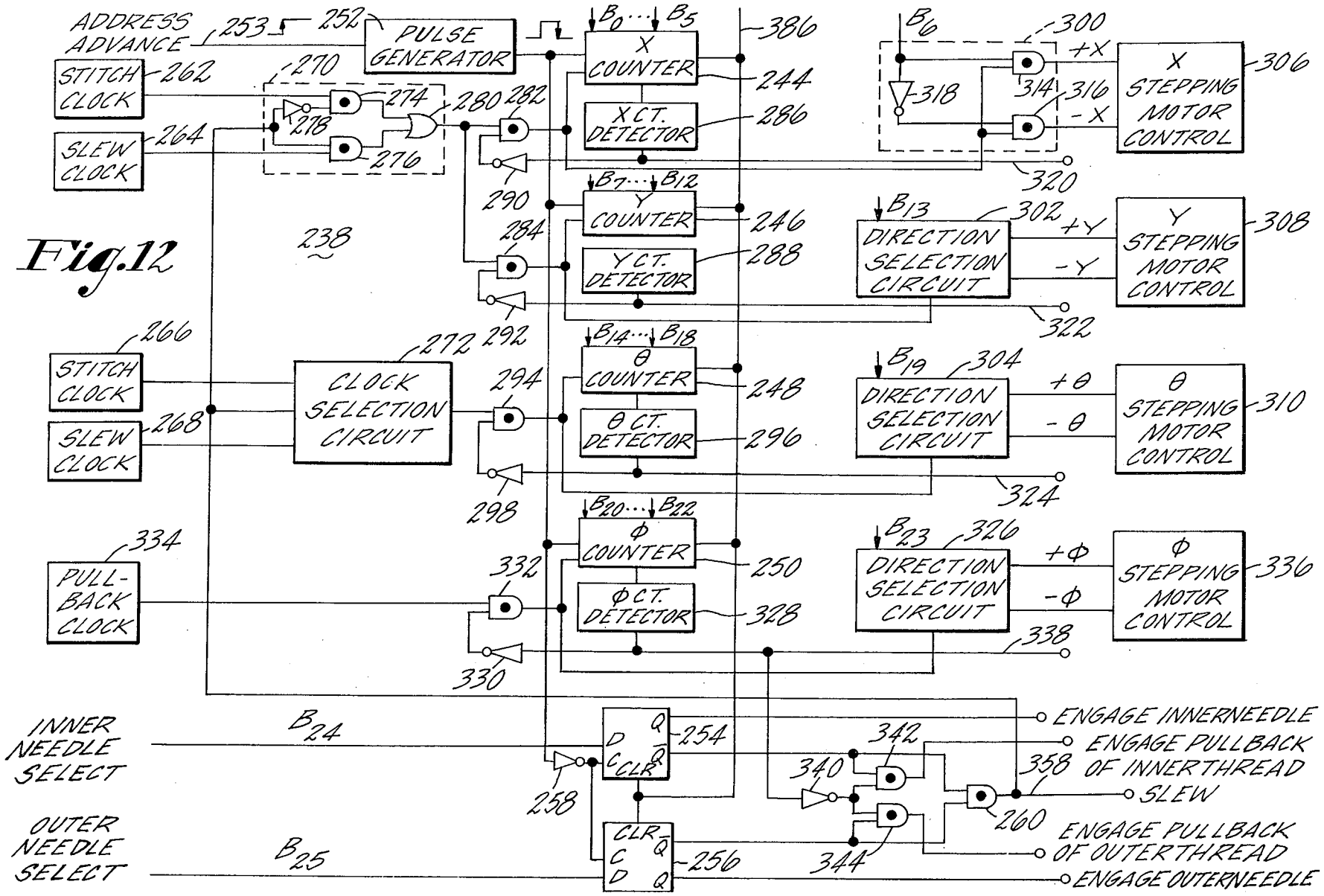
FIG. 12 further illustrates the drive portion of the digital control system of FIG. 11.

Referring to FIG. 12, the drive system 238 is illustrated in detail. The drive system 238 comprises drive logic for each of the parameterized movements, namely, X, Y, $\theta$ and $\phi$ movements. The magnitudes of each particular parameterized movement are applied to counters within the drive system. In this regard, an X-counter 244, receives the X magnitude of movement as defined by the bits $B_0$–$B_5$; a Y-counter 246 receives the Y magnitude of movement as defined by the bits $B_7$–$B_{12}$; a $\theta$ counter 248 receives the $\theta$ magnitude of movement as defined by the bits $B_{14}$–$B_{18}$; and a $\phi$ counter 250 receives the $\phi$ magnitude of movement as defined by the bits $B_{20}$–$B_{22}$. The aforementioned magnitudes of movement are loaded into the respective counters by a load pulse issued from a pulse generator 252. The pulse generator 252 is triggered by the address advance signal from the AND gate 236 via a line 253. It will be remembered that this signal from the AND gate 236 is generated at such time as a no storage location is to be addressed. In order to allow sufficient time for the contents in the newly addressed storage location to be made available to the various counters 244 through 250, the pulse generator 252 issues a pulse of a prescribed width wherein the trailing edge thereof triggers the loading of various counters.

A set of flip-flops 254 and 256 are also loaded at the same time as the aforementioned counters 244 through 250. These flip-flops receive the bits $B_{24}$ and $B_{25}$ at their respective D inputs. This information is loaded pursuant to the trailing edge of the load pulse from the pulse generator 252 which is applied to the respective C inputs of the flip-flops 254 and 256 via an inverter 258.

The inverter 258 merely defines a positive going trailing edge for the purpose of clocking the flip-flops. It will be remembered that the bits $B_{24}$ and $B_{25}$ define the selective engagement of the two needles. In this regard a binary one indicates that a needle is to be engaged and driven into the fabric whereas a binary zero represents a non-engagement of the needle. The binary values of the bits $B_{24}$ and $B_{25}$ are each reflected at the outputs of their respective flipflops. In this regard, a Q output will be logically high when the particular needle is to be selected. On the other hand, a $\overline{Q}$ output will be logically high when the particular needle is to remain disengaged. It is to be noted that the $\overline{Q}$ outputs of the flip-flops 254 and 256 are applied to an AND gate 260. The output of the AND gate 260 will be logically high when the $\overline{Q}$ outputs of the flip-flops 254 and 256 are logically high indicating a non-selection of both needles. This is defined as a slew condition and the logically high output signal from the AND gate 260 will be hereinafter referred to as the slew signal. The slew signal from the AND gate 260 is utilized to select the type of dynamic drive that is to be subsequently executed by the drive system 238. In this regard, the drive system 238 is operative to either execute a slew type of drive or a stitch type of drive. The slew type of drive is predicated on there not being a need to stitch after completing the movement of the workpiece. On the other hand, the stitch type of drive requires a movement of the workpiece followed by the formation of a stitch. These two different types of drive require different rates of movement. The X and Y rates of movement for a stitch type of drive are defined by a stitch clock 262. The X and Y rates of movement for a slew type of drive are defined by a slew clock 264. The $\theta$ rate of movement for a stitch type of drive is defined by a stitch clock 266 whereas the $\theta$ rate of movement for a slew type of drive is defined by a slew clock 268. The clocking circuits 262, 264, 266, and 268 are standard muti-vibrator circuits which produce trains of pulses at prescribed frequencies. The particular frequencies which are assigned to each of the clocks depends on the relative timing requirements of the function which is to be executed. In this regard, the clocking frequencies for the stitch clocks 262 and 266 must be such as to assure completion of the maximum amounts of X and Y movement plus $\theta$ rotation that is to possibly be encountered before a needle engagement with the workpiece. The particular frequencies assigned to each of the clocks also depends on the mechanical drive system associated therewith. The X and Y mechanical drive systems must move a support for the workpiece W, whereas the $\theta$ mechanical drive system must accomplish an angular positioning of the two needles.

The clocking signals from the stitch clock 262 and the slew clock 264 are applied to a clock selection circuit 270. The clocking signals from the stitch clock 266 and the slew clock 268 are applied to a clock selection circuit 272. The clock selection circuits 270 and 272 also receive the slew signal from the AND gate 260. As will now be explained, the clock selection circuits are operative to select the clocking signals from either the stitch clocks or the slew clocks depending on whether or not a slew condition has been indicated at the output of the AND gate 260.

Referring to the clock selection circuit 270, it is seen that an AND gate 274 receives a stitch clocking signal from the stitch clock 262. An AND gate 276 receives a slew clocking signal from the slew clock 264. The AND gate 276 also receives the slew signal from the AND gate 260 whereas the AND gate 274 receives an inverted slew signal from an inverter 278. It will be remembered that the slew signal is logically high for a slew condition. This will enable the AND gate 276 so as to thereby gate the slew clocking signal. On the other hand, a logically low slew signal will enable the AND gate 274 so as to thereby gate the stitch clocking the signal. In either case, the resulting gated clocking signal will be further gated through an OR gate 280. The clocking signal at the output of the OR gate 280 will be utilized to define the rate of X and Y movement as will now be explained.

The output of the OR gate 280 is applied to both an AND gate 282 and an AND gate 284. The AND gate 282 will be enabled when an X movement is to occur whereas the AND gate 284 will be enabled when a Y movement is to occur. It will be remembered that the X-counter 244 will be loaded with a non-zero count whenever movement is to occur in the X direction, whereas the Y-counter 246 will be loaded with a non-zero count when a Y movement is to occur. These respective non-zero counts are detected by an X-count detector 286 and a Y-count detector 288. These count detectors generate a logically low signal when a non-zero count is detected in their respective counters. The logically low signal from the X-count detector 286 is inverted by an inverter 290 so as to enable the AND gate 282. The logically low signal from the Y-count detector 288 is inverted by an inverter 292 so as to enable the AND gate 284.

The aforementioned selection and gating of clocking signals is with respect to the X and Y movements. As has been previously indicated, a clock selection circuit 272 performs the selection function for the $\theta$ movement. Specifically, the clock selection circuit 272 selects either a stitch clock signal from the stitch clock 266 or a slew clock signal from the slew clock 268. The clock selection circuit 272 is operative to select the appropriate clocking signal in response to the signal level of the slew signal. This is accomplished by an internal gating arrangement which is similar to the gating arrangement for the clock selection circuit 270. This gating arrangement produces an appropriate $\theta$ clocking signal at the output of the clock selection circuit 272. An AND gate 294 receives the $\theta$ clocking signal from the clock selection circuit 272. The AND gate also receives an indication as to whether or not $\theta$ movement is to take place. This occurs via a $\theta$ count detector 296 which detects the presence or absence of a non-zero count in the $\theta$ counter 248. The $\theta$ count detector will produce a logically low signal when a non-zero count is detected. This logically low signal will be inverted by an inverter 298 and applied to the AND gate 294. This will result in the AND gate being enabled when a movement is to occur.

Any of the enabled AND gates 282, 284, and 294 will gate the appropriately selected clocking signal from their respective clock selection circuits. In this regard, an enabled AND gate 282 will provide an X clocking signal to the X-counter 244 whereas an appropriately enabled AND gate 284 will provide a Y clocking signal to the Y counter 246 and an appropriately enabled AND gate 294 will provide a $\theta$ clocking signal to the $\theta$ counter 248.

The X, Y and $\theta$ clocking signals are also applied to direction selection circuits 300, 302, and 304. These direction selection circuits furthermore each receive a bit from the memory 230 via the bus 240 indicating a positive or negative movement or clockwise or counterclockwise movement. Direction selection circuit 300 receives the bit $B_6$ whereas the direction selection circuit 302 receives the bit $B_{13}$ and the direction selection circuit 304 receives the bit $B_{19}$. A binary one value for the bits $B_6$ and $B_{13}$ will indicate a positive direction whereas a binary zero value will indicate a negative direction. A binary one value for bit $B_{19}$ will indicate a clockwise rotation whereas a binary zero value will indicate a counterclockwise rotation.

The direction selection circuits are in each instance operative to select either of two outputs depending on the binary value of the respective incoming bit indicating positive or negative or clockwise or counterclockwise direction. The two outputs of the direction selection circuit 300 are connected to an X stepping motor control 306 whereas the two outputs of the direction selection circuit 302 are connected to a Y stepping motor control 308. The two outputs of the direction selection circuit 304 are connected to a $\theta$ stepping motor control 310. Each stepping motor control contains a stepping motor that implements the prescribed movement. The $\theta$ stepping motor control includes the stepping motor 20 illustrated in FIG. 2. The X and Y stepping motors are part of a conventional X—Y positioning system which have not been particularly shown.

Referring to the direction selection circuit 300, it is seen that the two outputs for this circuit are defined by a pair of AND gates 314 and 316. The bilevel signal indicating the binary value of the bit $B_6$ is directly applied to the AND gate 314 and is first inverted by an inverter 318 before being applied to the AND gate 316. In this manner, the AND gate 314 is enabled so as to gate the X clocking signal whenever the bit $B_6$ indicates a positive direction of movement. On the other hand, the AND gate 316 is enabled so as to gate the X clocking signal whenever the bit $B_6$ indicates a negative direction of movement. In either case, the X stepping motor control is operative to implement movement in the indicated direction in an amount prescribed by the number of pulses that are applied thereto.

The number of pulses which are applied to the X stepping motor control 306 is dictated by the binary count that has been stored in the X counter 244. In this regard, the binary count within the counter 244 is decremented by the trailing edge of each clocking pulse from the AND gate 282. This assures that the same clocking pulses have also been gated by the appropriately enabled AND gate 314 or 316. The gating of a pulse and subsequent decrementing of the binary count continues until the binary count within the X counter 244 reaches zero. At this time, the X count detector 286 provides a logically high bilevel signal at its output. This logically high signal is inverted through the inverter 290 so as to disable the AND gate 282. The thus disabled AND gate 282 prevents any further X clocking pulses. It is to be noted that the output of the X count detector 286 is also carried over a line 320 which forms part of the bus 242. It will be remembered that the signals present in the bus 242 are utilized as conditions precedent to incrementing the address within the address register 232. This will be further discussed hereinafter.

A prescribed number of pulses may also be applied to the Y stepping motor control 308 and the $\theta$ stepping motor control 310. In this regard, the appropriately enabled output of the direction selection circuit 302 and the direction selection circuit 304 will result in a train of pulses being applied to the respective stepping motor controls. The Y and $\theta$ stepping motors will in each instance be operative to move in the indicated direction by an amount prescribed by the number of pulses that are applied thereto. The number of pulses that are applied to the Y motor control 308 are equal to the binary count previously loaded into the Y counter 246. The number of pulses which are applied to the $\theta$ motor control 310 are defined by the binary count that has been previously loaded into the $\theta$ counter 248. The binary count within the Y counter is monitored by the Y count detector 288 whereas the binary count within the $\theta$ counter is monitored by the $\theta$ count detector 296. These count detectors are operative to generate logically high signals when the respectively monitored binary counts reach zero. The logically high signal from the Y count detector 288 is inverted through an inverter 292 so as to disable the AND gate 284. The logically high signal from the $\theta$ count detector 296 is inverted through an inverter 298 so as to disable the AND gate 294. In each instance, the disablement of the respective AND gate limits the number of pulses applied to the respective stepping motor control. It is to be noted that the output signals from the Y count detector 288 and the $\theta$ count detector 296 are also carried by a set of lines 322 and 324 which form part of the bus 238. As has been previously indicated, these signals are utilized as conditions precedent to incrementing the address within the address register 232.

In addition to the control of the X, Y and $\theta$ movements, the drive system 238 is also operative to implement a pullback of thread when so commanded. It will be remembered that a pullback command is defined by the bits $B_{20}$ through $B_{23}$. The magnitude of the pullback is particularly defined by the bits $B_{20}$ through $B_{22}$ that are applied to the $\phi$ counter 250. The direction of pullback, as indicated by the bit $B_{23}$, is applied to the direction selection circuit 326. The loading of a particular magnitude of pullback into the $\phi$ counter 250 will cause the $\phi$ count detector 328 to drop logically low. This logically low signal is inverted by an inverter 330 so as to enable an AND gate 332. Clocking pulses from a pullback clock 334 will be subsequently gated through the AND gate 332 and applied to the $\phi$ counter 250 and the direction selection circuit 326. The direction selection circuit 326 will have either its plus or minus output enabled so as to apply a train of pulses to the $\phi$ stepping motor drive control 336. The stepping motor drive control 336 will cause the $\phi$ stepping motor 178 in FIG. 5 to move a prescribed number of steps dictated by the number of pulses that are applied thereto. The number of pulses that are thus applied are controlled by the binary count in the $\phi$ counter 250. This binary count is decremented in the same manner as has been previously described with respect to the X, Y and $\theta$ counters. When the binary count reaches zero. the $\phi$ count detector 328 disables the AND gate 332 and moreover signals a count of zero on a line 338 which constitutes one of the signal lines within the bus 242.

The signal on line 338 is also fed through an inverter 340 to a pair of AND gates 342 and 344. This signal will be logically low when the $\phi$ count detector 328 detects a non-zero binary count in the $\phi$ counter 250. This will of course occur when a pullback is to take place. The logically low signal is inverted through the inverter 340 so as to enable the AND gats 342 and 344. The AND gates 342 and 344 also receive negation signals from the $\overline{Q}$ outputs of the flip-flops 254 and 256. It will be remembered that a $\overline{Q}$ output of one of the flip-flops 254 and 256 will be logically high when the needle select bit associated therewith is a binary zero. In other words, the $\overline{Q}$ output of the flip-flop 254 will be logically high when the needle select bit $B_{24}$ for the inner needle is a binary zero. This will result in a logically high signal at the output of the AND gate 342 if the same has been previously enabled. The logically high signal at the output of the AND gate 342 will be utilized to pull back the thread associated with the inner needle. This is accomplished by actuating a solenoid valve within the respective air motor 192 in FIG. 5. The activated air motor causes the idler roller 182 associated therewith to press the thread against the friction roll 180. The friction roll 180 will turn an amount prescribed by the stepper motor 178 which is itself controlled by the stepping motor 336.

It is to be understood that a similar thread pullback may be implemented with respect to the thread associated with the outer needle. This will occur when the bit $B_{25}$ indicates a non-selection of this needle and a pullback count has furthermore been loaded into the $\phi$ counter 250. This combination of signal conditions will ultimately result in a logically high signal at the $\overline{Q}$ output of the flip-flop 256 which will produce a logically high signal at the output of the AND gate 344.

Referring again to FIG. 11, it is seen that the various signal lines 320, 322, 324 and 338 are each connected to the input side of the AND gate 236. It will be remembered that the bilevel signals present on these lines serve to indicate when a presently commanded movement has been completed. When this occurs, all bilevel signals on these lines will be logically high.

In addition to the aforementioned bilevel signals, the AND gate 236 also receives a "start" signal. This signal is generated by a start switch 350 in combination with a one-shot circuit 352 and an inverter 354. The generation of the "start" signal by these particular elements will be described in detail hereinafter. For the moment, it is merely to be understood that this signal will be logically high after an initial start up sequence.

The only remaining bilevel signal that is applied to the input side of the AND gate 236 originates from an OR gate 356. The OR gate 356 is operative to gate either of the two input signals which are applied thereto. One of the input signals is the slew signal from the drive system 238. The slew signal is carried over a line 358 from the AND gate 260 (within the drive system 238) to the OR gate 356. The other input signal to the OR gate 356 arrives via a line 360 from a pulse generator 362. As will be explained in detail hereinafter, the pulse generator 362 will be operative to generate a pulse during a stitch type of drive or operation. On the other hand, a logically high slew signal will be present on the line 358 during a slew operation.

Referring first to the generation of a slew signal during a slew operation, it will be remembered that a logically high signal indicating that a slew is to take place occurs at the output of the AND gate 260. This logically high signal occurs immediately after the bits $B_{24}$ and $B_{25}$ have been loaded into the flip-flops 254 and 256. This will mean that the slew signal on the line 358 will occur prior to any actual movement under the slew condition.

The slew signal on the line 358 will therefore go logically high prior to all feedback signals on the lines 320, 322, 324 and 338 having gone logically high. In other words, the bilevel signals on these respective lines will not indicate a completion of slew movement prior to the slew signal itself having gone logically high. This will mean that the output of the OR gate 356 will not be the last input signal to the AND gate 236 to have gone logically high. In other words, the bilevel signal indicating completion of the slew movement will occur after the output of the OR gate 356 has gone logically high. This will mean that the AND gate 236 will remain logically low until such time as the last parameterized movement associated with the slew operation has been completed. At this time, the bilevel signal associated therewith will go logically high so as to produce a positive signal transition to a logically high signal state at the output of the AND gate 236. As has been explained previously, such a positive transition to a logically high signal state will be operative to increment the address within the register 232. This signal will also be utilized to initiate loading of the newly addressed information from the memory 230 into the drive system 238.

It is to be appreciated that the aforementioned incrementing of an address upon the completion of a slew operation is not nearly as common as the incrementing of an address following the completion of a stitching operation. The incrementing of an address following the completion of a stitching operation is premised on the generation of a pulse by the pulse generator 362. The timing for the generation of a pulse by the pulse generator 362 is controlled by a needle position detection circuit 364. The needle position detection circuit 364 is operative to provide a logically high signal to the pulse generator 362 via a line 366 when the sewing needle moves up and out of the workpiece. This logically high signal from the needle detection circuit 364 will be hereinafter referred to as the "needles up" signal. The pulse generator 362 produces a pulse in response to the "needles up" signal. This pulse is gated through the OR gate 356 and applied to the input side of the AND gate 236. The AND gate 236 will be enabled at such time as the gated pulse from the OR gate 356 is thus applied. This follows from the fact that the enablement of the AND gate 236 is otherwise premised on a completion of the previously ordered movement. It is to be appreciated that the previously ordered movement will have been completed prior to the actual stitching of the workpiece and hence prior to the generation of a "needles up" signal. The thus enabled AND gate 236 produces a positive signal transition at its output in response to the gated pulse from the OR gate 356. The positive signal transition constitutes an address advance signal which is applied to both the address register 232 and the drive system 238. As has been previously explained, this address advance signal is operative to increment the address within the address register 232 as well as initiate loading of the newly addressed information from the memory 230 into the drive system 238.

The actual stitching of the workpiece is controlled by a sewing machine motor control 368. The sewing machine motor control 368 controls the sewing machine motor which in turn engagably drives the needles upwardly and downwardly with respect to the workpiece. The sewing machine motor control receives the "needles up" signal via a line 370 and the slew signal via a line 372. The sewing machine motor control is operative to inhibit needle movement in response to a logically high slew signal on the line 372 and a logically high "needles up" signal on the line 370. These two signal conditions essentially indicate that needle movement is to terminate as soon as the needles have been physically removed from the workpiece at the end of the stitch operation. The sewing machine motor control 368 is again turned on so as to initiate further needle movement in response to the slew signal dropping logically low at the beginning of the next stitching operation. The sewing machine motor control 368 subsequently executes successive cycles of needle movement when stitching operations are to occur.

The process of incrementing the address in the address register 232 and subsequently implementing the particular stitch or slew operation defined by the addressed memory location continues until an "end of pattern" occurs. This is marked by the 27th bit $B_{26}$ of an addressed location being a binary one. This binary one value of the 27th bit will produce a logically high signal on a line 374. The transition in the bilevel signal carried over the line 374 will trigger a negative pulse generator 376. The negative pulse generator 376 generates a negative pulse which is applied to an AND gate 376. The AND gate 378 also receives a normally logically high signal on a line 380 from a flip-flop 382. The negative pulse therefore causes the output of the AND gate 378 to drop logically low. The output of the AND gate 378 is connected to the reset terminal of the address register 232 by a line 384. The drop in signal level at the output of the AND gate 378 in response to the negative going pulse from the pulse generator 376 is operative to hold the address register 232 in a reset condition. The address, which is thus set, is preferably a zero memory address for the memory 230. This addressed location contains all binary zeros.

The sewing of the next pattern is initiated by depressing the start switch 350. This triggers a one-shot 352 which generates a pulse of prescribed width. This pulse normally does not have any effect on the flip-flop 382. The pulse from the one-shot 352 is also inverted by the inverter 354 and applied to the input side of the AND gate 236. This constitutes the "start" signal which is logically low for the duration of the pulse from the one-shot circuit 352. It is to be appreciated that all other input signals to the AND gate 236 will be logically high during this interim. This is attributable to the fact that the last previously addressed location in the memory 230 contains all binary zeros. This guarantees that all drive functions will be at a binary zero condition. This will cause the bilevel signals on the lines 320, 322, 324 and 338 to be logically high. Furthermore, the slew signal in the line 358 will be logically high so as to thereby cause the OR gate 356 to be logically high. Hence, the AND gate 236 will be enabled so as to respond to the "start" signal when the same goes logically high at the end of the pulse from the one-shot 352. This causes the AND gate 236 to switch logically high so as to thereby define an "address advance signal". This increments the address in the address register 232 to a memory address of one. This particularly addressed location defines the first operation to be implemented by the drive system 238.

The only remaining portion of the control logic to consider is the initializing logic. The initializing logic begins with a standard power supply circuit 384 which generates a "power on" signal when the power is turned on. This "power on" signal is a prescribed voltage level which resets the flip-flop 382 to a logically low state. The logically low signal condition at the output of the flip-flop 382 is applied to the AND gate 378 via the line 380. This causes the AND gate 378 to go logically low which in turn sets and holds the address register 232 at a memory address of zero. The logically low output of the flip-flop 382 is also applied to the drive system 238 via a line 386. Referring to FIG. 12, it is seen that the signal on the line 386 is applied to the reset terminals of the X-counter 244, the Y-counter 246, the $\theta$ counter 248, the $\phi$ counter 250 and the flip-flops 254 and 256. The signal on the line 386 is operative to set the counts to zero in the various counters. The zero counts in the counters will cause their respective count detectors to produce logically high signals on the lines 320, 322, 324 and 338. The signal on the line 386 will also clear the flip-flops 254 and 256. The cleared flip-flops 254 and 256 will generate logically high output signals at their respective $\overline{Q}$ terminals. This in turn causes the AND gate 260 to produce a logically high slew signal on the line 358. The logically high slew signal on the line 358 will set the output of the OR gate 356 in FIG. 11 logically high. This completes the initialization of the logic following the turning on of power. A sewing pattern resident in the memory 230 may now be executed by depressing the start switch 350. The depression of the start switch 350 will trigger the one-shot 352 which generates a pulse of prescribed width. The leading edge of this pulse is operative to set the flip-flop 382 to a logically high state from the logically low state that it was in following the reset by the power supply circuit 384. The logically high output of the flip-flop 382 will be applied to the AND gate 378 via the line 380 so as to thereby cause the AND gate 378 to go logically high. This will in turn release the hold on the address register 232 which has been held at the zero memory address. Returning to the pulse generated by the one-shot 352, it is seen that this pulse is inverted through the inverter 354 and thereafter applied to the input side of the AND gate 236. It will be remembered that this inverted pulse signal constitutes the "start" signal. It will furthermore be remembered that the AND gate 236 is otherwise enabled by virtue of all other input signals having been set logically high during the initializing of the logic at the time that power is turned on. Hence, a positive signal transition in the start signal (at the end of the inverted pulse) will produce a positive going signal at the output of the AND gate 236. This increments the address register 232 to a memory address of one which defines the first storage location containing specific information relevent to the execution of the particular sewing pattern.

DESCRIPTION OF OPERATION

Figure 13:
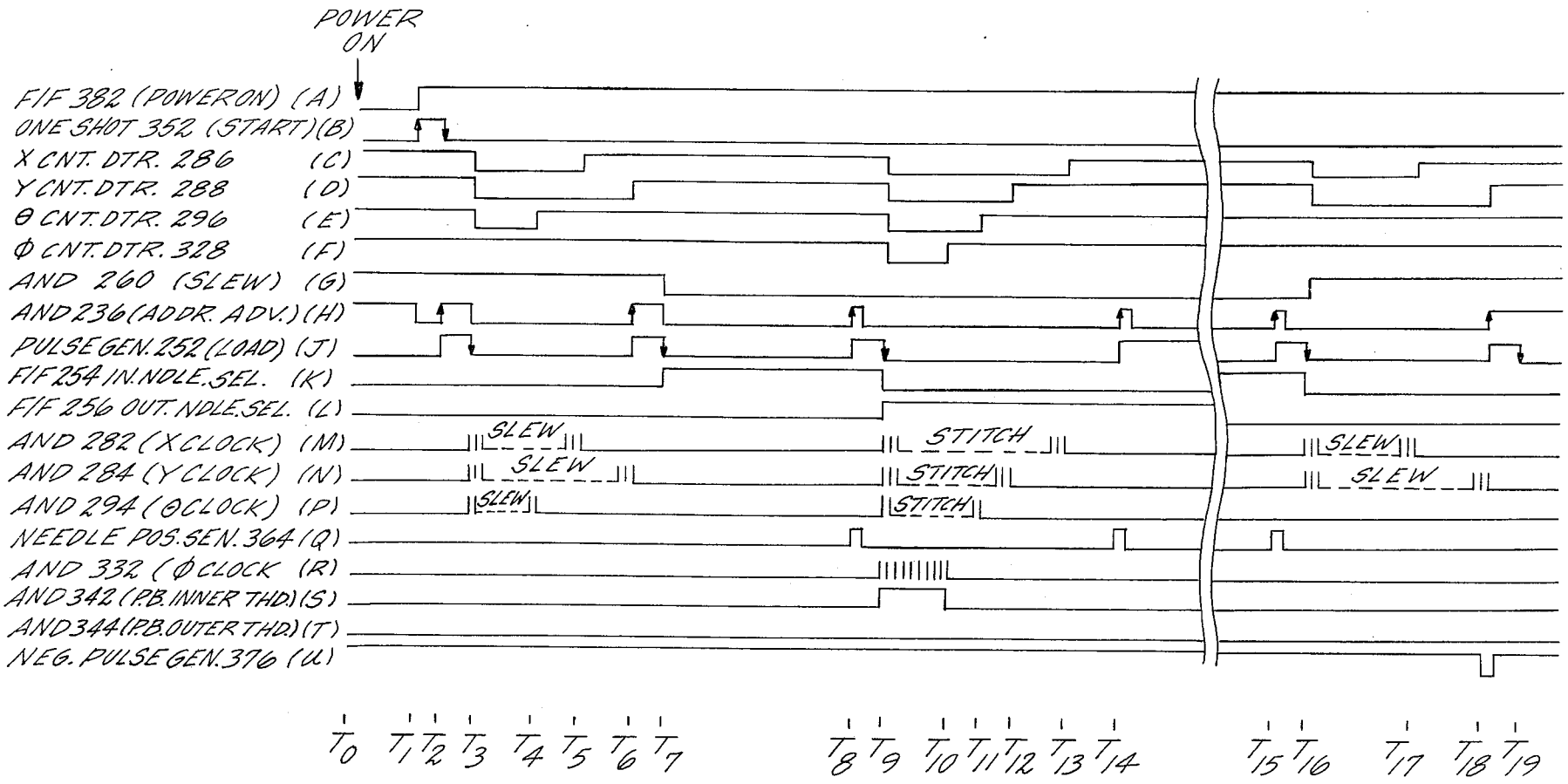
FIG. 13 is a diagram of various signals appearing in the digital control system of FIGS. 11 and 12.

The description of the operation of the logic illustrated in FIGS. 11 and 12 can be best understood by referring to a diagram of signal waveforms appearing in FIG. 13. The various waveforms appearing in FIG. 13 occur at locations within the aforementioned logic. The particular locations will become apparent during the description which follows.

Waveform A depicts the output of the flip-flop 382 which is held in a logical zero state at time $T_0$ when the power is turned on. It will be remembered that this signal resets the address register 232 to an address count of zero. This signal is also used to reset the X, Y, $\theta$, and $\phi$ counters. This in turn causes the outputs of the respective count detectors to go logically high as is represented by the waveforms C through F. The signal from the flip-flops 382 also clears the needle select flip-flops 254 and 256 (waveforms K and L) so as to cause the slew signal as set forth in waveform G to go logically high. The AND gate 236 (waveform H) will be logically high at this time.

To begin an operation, the start switch 350 is depressed causing a pulse in the start signal of waveform B occuring at the output of the one-shot 352. At this time $T_1$, the flip-flop 382 (waveform A) is set to a logic one state which enables the X, Y, $\theta$, and $\phi$ counters. The address register 232 is held at an address of zero during this initialization by virtue of an inverted signal from the output of the one-shot 352. When the start signal at the output of the one-shot 352 goes logically low, the AND gate 236 transitions to a logically high state as indicated by time $T_2$ in the waveform H. This advances the address within the address register 232 to a memory address of one. This also initiates a load pulse at a time $T_2$ in the waveform j.

On the trailing edge of the load pulse in waveform J, occurring at time $T_3$, the contents of the currently addressed memory location are loaded into the appropriate X, Y, $\theta$, and $\phi$ counters as well as the needle select flip-flops 254 and 256. The Q outputs of the flip-flops 254 and 256 will stay low in waveforms K and L indicating that a slew operation is to occur. Since the slew mode has been selected, the X, Y, and $\theta$ clocking signals (as defined by waveforms M through P) will be at a slew clocking rate. The respective counters will count to zero at rates determined by the slew clock pulses. The X count detector will go logically high when the X count reaches zero at a time $T_5$. The Y-count detector will go logically high in waveform D at a time $T_6$ when the Y count reaches zero. The $\theta$ count detector will go logically high in waveform E at a time $T_4$ whenever the $\theta$ count reaches zero. When a count reaches zero, the respective clock input gate 282, 284 or 294 is disabled and no further clock pulses are issued in the waveforms M, N or P.

When all three counts reach zero at time $T_6$, the AND gate 236 will again be enabled causing the address register 232 to advance to the memory address of two. The newly addressed location contains data for the selection of the inner needle as is indicated by the needle select flip-flop 254 going logically high at time $T_7$ in waveform K. When a needle has thus been selected, the slew signal will go logically low as is indicated in waveform G. This causes the sewing machine motor to be turned on. With the sewing machine now rotating, a stitch will be formed. When the machine rotates to the up position, the needle up position sensor 364 will initiate a needle up pulse as is indicated at time $T_8$ in waveform Q. This will enable the AND gate 236 to generate another address advance signal. The address is thus advanced to a memory address of three.

The contents of the memory address three location contains data for X, Y, $\theta$, and $\phi$ as well as a selection of the outer needle. Since a needle has again been selected, the sewing machine motor will continue to run. It is to be noted that the various movements will occur at rates dictated by the X, Y, $\theta$, and $\phi$ clocks. The $\phi$ clock is denoted as waveform R. It will be remembered that the $\phi$ clock defines a prescribed amount of pullback of thread associated with the non-selected needles. The pullback in this instance is with respect to the thread associated with the inner needle at time $T_9$. This will continue to occur until time $T_{11}$. At this time, the $\phi$ count detector output in waveform F goes logically high so as to thereby terminate any further clocking signals to the $\phi$ stepping motor control. The $\theta$ count detector will have previously gone logically high at a time $T_{10}$ so as to thereby terminate the $\theta$ clock signals to the $\theta$ clocking motor. The Y movement will have been completed at a time $T_{12}$ whereas the X movement will have been completed at a time $T_{13}$. The AND gate 236 will be disabled until a "needle up" pulse occurs in the waveform Q at a time $T_{14}$. At this time, the address within the address register 232 will be incremented and a newly addressed location will be made available to the drive system. This process continues throughout the pattern with any combination of X, Y, $\theta$, $\phi$, movement that may be required by the particularly addressed located that is thereby addressed.

When a stitch pattern is complete, it may be necessary to slew back to the original starting point of the machine. The addressed memory location will in this instance contain only data for X and Y movements as is indicated at time $T_{16}$. The X and Y clocks in waveforms M and N will be at a slew clocking rate. When the X and Y counters have reached zero the X and Y count detectors will go logically high as is indicated at time $T_{17}$ in waveform C and time $T_{18}$ in waveform D. The AND gate 236 will subsequently go logically high so as to thereby increment the address to the memory 230. The last addressed location in the memory 230 will contain all zeros except for the 27th bit $B_{26}$. This causes a negative pulse to issue from the negative pulse generator 376 as is indicated in the waveform U. This pulse resets the address register to zero. The zero memory location contains all zeros so as to thereby stop the machine process at time $T_{19}$.

The aforementioned operation has been described relative to hardware logic of FIGS. 11 and 12. It is to be appreciated that similar control signals could be developed through the programming of a central processor which would interface with appropriate X, Y, $\theta$ and $\phi$ drive functions. In this regard, a central processor would be programmed so as to load X, Y, $\theta$ and $\phi$ information into various internal registers. The information within these registers would thereafter be used to govern the number of pulses issued to the motor controls in much the same manner as has been previously described with respect to the hardware logic of FIGS. 11 and 12. This would include provision for the slew and the stitch modes of operation as selective pullback of thread with respect to a given needle.

Figure 14A:
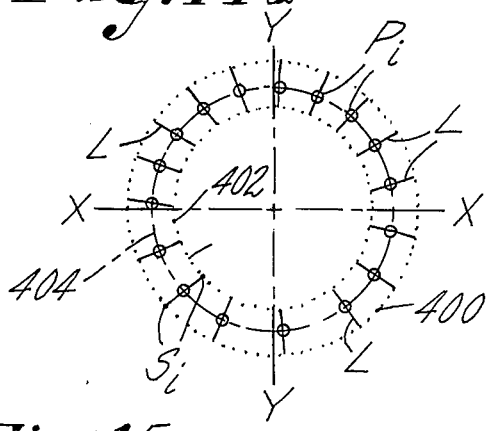
FIG. 14*a* illustrates the sewing of a concentric circular pattern of the presently disclosed two needle stitching machine.
Figure 14B:
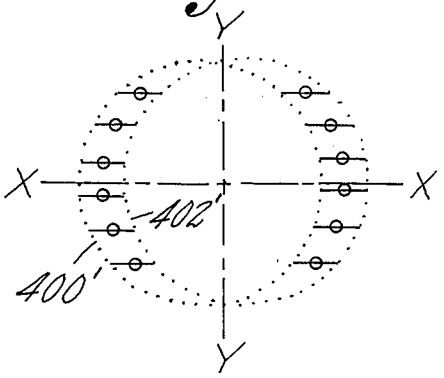
FIG. 14*b* illustrates the sewing of a concentric circular pattern by a conventional two needle stitching machine.

FIGS. 14*a* and 14*b* illustrate the flexibility obtained from the presently disclosed sewing machine. In particular, FIG. 14*a* illustrates the sewing of a pair of concentric circles 400 and 402 by the presently disclosed sewing machine whereas FIG. 14*b* illustrates an attempt to sew the same circles 400' and 402' by a conventional sewing machine.

Referring first to FIG. 14*a*, the concentric circular pattern is sewn by rotating the needles about their Z axis as well as moving the work in the X—Y plane. These movements have been previously discussed with regard to FIGS. 9 and 10. To briefly review, successive positions of the work relative to the Z axis are achieved by appropriate $X_i$ and $Y_i$ movements. This results in a circular path 404 consisting of relative positions $P_i$ of the Z axis with respect to the work. The needles are moreover rotated by predetermined amounts in FIG. 14*a*. The amount of rotation is always such as to maintain perpendicularity of a line L (interconnecting the tips of the needles) with respect to a tangent to the circular path 404 at each point $P_i$. This results in the formation of stitches $S_i$ that are always tangent to the respective concentric circles 400 and 402. This produces the desirable tangency stitch effect whereby all stitches are tangent to the path of the pattern.

The tangency stitching of 14*a* is to be contrasted with the attempt to execute the same concentric circular pattern in FIG. 14*b*. It is to be noted that the needles in FIG. 14*b* are not rotated about the Z axis. This results in the formation of a pair of non-concentric circles 400' and 402'. The stitches formed in these circles will not be tangent to the circles. The lack of a $\theta$ rotation moreover causes an X increment to approach zero when the Y dimension is at its greatest. It is of course to be understood that the effect demonstrated in FIG. 14*b* is sometimes desired. This can of course be accomplished by the presently disclosed machine which allows for this type of sewing also.

It is to be appreciated that FIG. 14*a* merely represents a special case of two needle tangency stitching. The concept of tangency stitching may be effectively implemented with respect to any number of single or two needle patterns. Some of these may simply be maintaining tangency with respect to either a curved or straight pattern path. This path may be with respect to the contour or edge of a particular work or it may be for the purpose of implementing a join and sew operation. In some cases, tangency stitching of parallel seams may be desirable for a portion of a pattern which is to be followed by predetermined varations of $\theta$ for the remainder of the pattern. This might be furthermore supplemented with a deactivation of one or the other needles and a reactivation of the same as called for by the particular pattern. This latter capability has been previously discussed relative to FIG. 10.

Figure 15A:
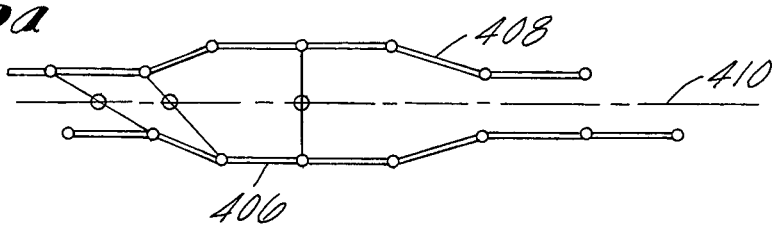
FIGS. 15*a*–15*e* show a few sample novel stitching paths executed by the presently disclosed two needle stitching machine.
Figure 15B:
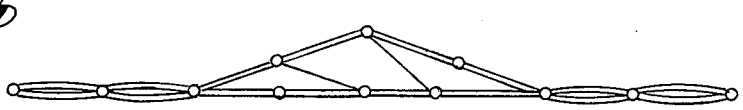
Figure 15C:
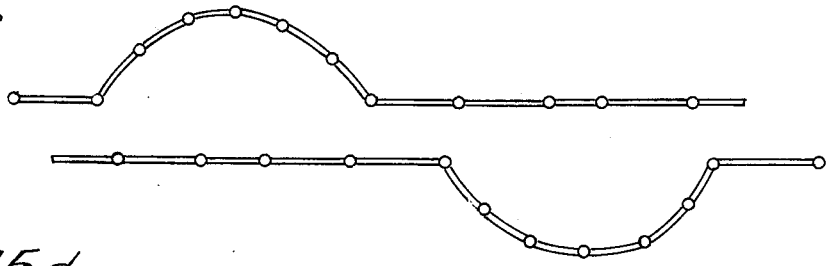
Figure 15D:
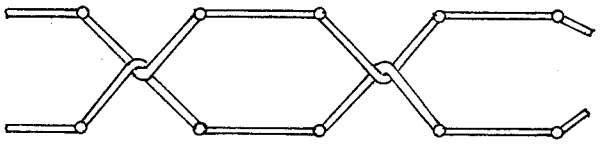
Figure 15E:
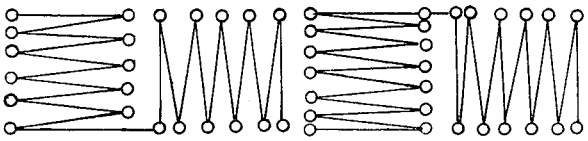

FIGS. 15*a* through 15*e* illustrate but a few examples of the aforementioned stitching capabilities. FIG. 15*a* shows different spacings between stitch rows 406 and 408 which are attained by varying the angle $\theta$ as the material is moved in a single direction along a line 410. FIG. 15*b* shows both threads first being in the same row and thereafter becoming separated into two rows having a variable distance therebetween in accordance with predetermined variations of the angle $\theta$. FIG. 15*c* shows a pattern wherein row spacing is varied and additionally one needle is disengaged for an interval to permit the other needle to sew an independent design as directed by X and Y feed components. The pattern shown in FIG. 15*d* is obtained by a $\theta$ rotation of 360° so as to form a cross containing a half twist. The pattern shown in FIG. 15*e* shows a single needle zig-zag pattern wherein the zig-zag pattern is alternately rotated 90° by the $\theta$ drive mechanism.

From the foregoing, it is to be appreciated that a preferred embodiment has been disclosed for an apparatus which moves a workpiece while simultaneously rotating operative tools relative thereto. It is to be appreciated that alternative structure may be substituted for elements of the preferred embodiment without departing from the scope of the present invention. In this regard, an alternative software embodiment has already been previously alluded to herein. Various alternative mechanical structure may also be substituted for various elements of the preferred embodiment without departing from the scope of the present invention.

What is claimed is:

1. A method of forming stitch paths at selected distances apart on a workpiece translatable in its own general plane which comprises, providing in a sewing machine a needle bar reciprocable on an axis and carrying a plurality of needles into and out of the workpiece from one side thereof, providing a plurality of thread hooking devices operable on thread on the opposite side of the workpiece, each of the thread hooking devices being rotatable about said axis, and causing the needle bar and thread hooking devices to be rotated about the common axis when the plurality of needles are disengaged from the workpiece so that a line interconnecting the tips of the needles at their workpiece engaging localities is maintained at arbitrarily predetermined angles to the translation path of the workpiece during operation of the machine wherein the distance between stitch paths is selectively varied by changing said line from a maintained perpendicularity to a selected angle or succession of selected angles less than 90°.

2. A method of stitching a corner pattern requiring the stitching of an outer corner and an inner corner, the corner pattern being formed by operating a first needle along an outer stitch path in conjunction with operating a second needle along an inner path, disabling the second needle when the apex of the inner corner has been reached and sewing only with the first needle until the apex of the outer corner is reached, rotating the second needle about the apex of the outer corner while maintaining the first needle substantially at the apex of the outer corner, operating the first needle along the new outer stitch path, pulling the thread back through the second needle by an aggregate amount substantially equal to the amount of thread pulled out during the relative movement of the second needle and the pattern following the disablement of the second needle, again operating the second needle along a new inner stitch path when the apex of the inner corner is passed by the second needle.

3. A sewing machine operable on a workpiece translatable in its own general plane along predetermined paths comprising stitching instrumentalities rotatable about an axis of rotation normal to said plane, said instrumentalities comprising both a needle bar reciprocable on said axis of rotation for carrying at least one needle into and out of the workpiece and a stitch-forming assembly operative on the opposite side of the workpiece from the needle for hooking thread fed therefrom, means for rotating both said needle bar and said stitch-forming assembly about the axis of rotation, and an automatic control system for ordering a sequence of predetermined angular rotations for controlling said means for rotating both said needle bar and stitch-forming assembly.

4. The machine of claim 3 wherein said automatic control system comprises:

means for ordering a sequence of predetermined movements of the workpiece relative to the axis of rotation so as to thereby define a path of successive positions of the axis of rotation on the workpiece; and means for separately ordering a sequence of predetermined angular rotations, said angular rotations having been arbitrarily predetermined so as to define the spacing of the path of the needle relative to the path of the axis of rotation on the workpiece.

5. The sewing machine of claim 3 wherein said control system comprises:

means for ordering a sequence of predetermined angular rotations, the angular rotations being predetermined independently of the motion of the workpiece.

6. The machine of claim 5 wherein said control system further comprises:

means for storing the sequence of predetermined angular rotations, the stored sequence being accessed and implemented by said means for ordering a sequence of predetermined angular rotations.

7. A machine as in claim 3 wherein the needle bar carries one needle offset from and parallel to said axis and another needle parallel to said axis and offset therefrom to substantially the same extent, and wherein the stitch-forming assembly includes a pair of thread hooking devices respectively rotatable about axes also equally offset and parallel to the needle bar axis.

8. A machine as in claim 7 wherein said pair of thread hooking devices tend to rotate about their respective axes in response to a rotation of said stitch-forming assembly, this rotation being corrected by:

means for counteracting the rotation of said thread hooking devices about their respective axes during the rotation of said stitch-forming assembly.

9. A machine as in claim 7 wherein mechanism response to said automatic control system is provided for rendering either of the needles of said pair of needles operative or inoperative at a predetermined locality on the workpiece during operation of the machine.

10. A machine as in claim 11 wherein said means for counteracting the rotation of said thread hooking devices about their respective axes in response to a rotation of said stitch-forming assembly further comprises:

means for rotating said thread hooking devices about their respective axes;

means for differentially connecting said means for rotating said hooking devices about their respective axes with said means for rotating said stitching instrumentalities, said differential connecting means being operative to drive said means for rotating said hooking devices in a manner which counteracts the rotation of said hooking devices that is caused by the rotation of said stitch-forming assembly.

11. A machine as in claim 10 wherein said means for rotating said thread hooking devices about their respective axes comprises:

means for normally rotating said thread hooking devices about their respective axes in synchronization with the reciprocal motion of said needle bar.

12. A machine as in claim 3 wherein mechanism response to said automatic control system is provided for rendering one of the needles inoperative at a predetermined locality on the workpiece during operation of the machine.

13. A machine as in claim 12 wherein mechanism response to said automatic control system is provided for pulling back thread under the control of said control system so as to avoid excess slack in a thread associated with an inoperative needle.

14. A machine as in claim 13 wherein said thread pull-back mechanism comprises a reversible motor which induces or removes thread slack, the inducement of thread slack at the needles being appropriately timed so as to facilitate thread snipping thereat.

15. The machine of claim 3 wherein said control system comprises:

a memory having a plurality of addressable storage locations, said storage locations containing information descriptive of the rotation of the sewing needles and information descriptive of the movement of the workpiece;

means for addressing at least one storage location within said memory upon the completion of a sewing cycle;

means for accessing the information stored in the currently addressed storage location; and means for ordering movement of the workpiece and rotation of the needles in response to the accessed information.

16. The machine of claim 15 wherein said control system further comprises:

means for defining at least two different modes of operation, the first mode being a slew mode and the second mode being a stitch mode, the slew mode being characterized by a suspension of needle movement, the stitch mode being characterized by at least one needle penetrating the workpiece following the positioning of the needles and the positioning of the workpiece.

17. The machine of claim 16 wherein said means for addressing at least one storage location comprises:

means, responsive to the means for defining the stitch mode and the slew mode, for incrementing the address to said memory upon the completion of a stitch during a stitch mode and for incrementing the address to said memory upon completion of the movement of the workpiece and rotation of the needles during a slew mode.

18. The machine of claim 16 wherein said control system further comprises:

first clocking means for generating at least one clocking signal for the slew mode of operation;

second clocking means for generating at least one clocking signal for the stitch mode of operation;

means, responsive to said means, for defining at least two modes of operation, for selecting the appropriate clocking signal from either said first clocking means or said second clocking means.

19. The machine of claim 18 wherein said control system further comprises:

means, responsive to the selected clocking signal, for implementing the ordered movement of the workpiece and rotation of the needles.

20. The machine of claim 15 wherein the information in said memory furthermore includes needle selection information and said control system furthermore comprises:

means for selectively activating the needles carried on said needle bar in response to the needle selection information so that only the selectively activated needles move into and out of the workpiece.

21. The machine of claim 20 wherein the memory furthermore contains information descriptive of predetermined amounts of thread pull and wherein said control system comprises:

means for accessing the information descriptive of predetermined amounts of thread pull, and means for ordering predetermined amounts of thread pull.

22. The machine of claim 21 further comprising:

means for moving thread a prescribed amount in response to the ordering of a predetermined amount of thread pull.

23. The machine of claim 22 wherein the information descriptive of predetermined amounts of thread pull furthermore indicates either of two directions for the thread pull and said means for moving thread is operative to move the thread the prescribed amount in the indicated direction.

24. The machine of claim 22 wherein said means for moving thread a prescribed amount furthermore comprises:

at least two means for engaging thread, each being associated with the thread for a particular needle and being operative to engage the particular thread when the needle associated therewith is not otherwise activated for sewing and a thread pull been ordered.

25. The machine of claim 24 wherein said means for moving thread a prescribed amount further comprises:

thread driving means which moves a prescribed amount in response to the ordering of a predetermined amount of thread pull whereby the thread which has been engaged by said engaging means is brought into contact with said thread driving means so as to thereby be driven the predetermined amount.

26. In a sewing machine including a workpiece support and means for guiding the support predeterminedly in a plane, a reciprocable needle bar, rotatable about an axis of rotation, for carrying a plurality of sewing instrumentalities toward and from successive workpiece engaging localities, mechanism for reciprocating the needle bar, an under-work stitch-forming assembly, and a control means synchronized with said reciprocating mechanism and responsive to predetermined control data for rotating both the needle bar and the under-work stitch-forming assembly about said axis of rotation when the sewing instrumentalities are disengaged from the fabric to selectively vary the angle of rotation of the needle bar and the under-work stitch-forming assembly for each successive stitch to be made by the instrumentalities.

27. A machine as in claim 26 and means responsive to said control means for selectively rendering a needle carried by the needle bar inoperative and operative at predetermined times during operation of the machine in response to predetermined control data.

28. A machine as in claim 27 wherein the needle bar is composite and includes a pair of relatively reciprocable needle carrying rods laterally offset from the axis, and a rotatable member journalled in the head and operatively connected to the rods, respectively, and to said means responsive to said control means for rendering a needle inoperative or operative whereby either of the rods may be rendered inoperative during operation of the machine.

29. A machine as in claim 26, and means for pulling back thread associated with an inoperative needle in response to predetermined control data.

30. A machine as in claim 26 wherein said means for guiding the workpiece support is also responsive to predetermined control data, the predetermined control data for guiding the workpiece support being arranged with respect to the predetermined control data for rotation of the bar and under-work stitch-forming assembly so as to define discrete movements of the workpiece support in conjunction with discrete rotations of the bar.

31. A method of spacing apart the operating paths of tools engageable with a workpiece translatable in a plane, said tools being mounted on a rotary carrier adapted to hold the tools in laterally spaced relation about an axis directly over the workpiece and normal to the plane, said method comprising the steps of:

defining a sequence of discrete movements for the workpiece so as to thereby define positions of the axis of rotation of the tool carrier relative to the workpiece lying directly underneath the axis of rotation;

defining a sequence of discrete angular rotations of the tool carrier only about the axis of rotation at each successive position of the axis of rotation so as to thereby arbitrarily define a desired spacing apart of the operating paths of the tools at each particular position of the axis of rotation;

moving the workpiece predeterminedly underneath the axis of rotation in accordance with the sequence of predefined movement commands for the workpiece; and concurrently angularly rotating the tool carrier only about the axis of rotation in response to the sequence of predefined discrete angular rotations for the tool carrier so as to thereby successively space apart the operating paths of the tools engageable with the workpiece.

32. A method as in claim 31 including moving the carrier toward and from the workpiece during intervals of non-engagement of the tools therewith.

33. A method as in claim 31 and further comprising providing an effect on the workpiece by rendering one of the tools inoperative for one or more intervals during operation of the machine.

34. A method as in claim 31 and providing an effect on the workpiece by alternately operating the tools of a pair.

35. The method of claim 31 further comprising the step of:

storing the discrete workpiece movements and the discrete angular rotations for subsequent use in conjunction with said steps of moving the workpiece and independently moving the tool carrier.

* * * * *

UNITED STATES PATENT OFFICE

CERTIFICATE OF CORRECTION

Patent No. 4,373,458 Dated February 15, 1983

Inventor(s) Adolph S. Dorosz et al

It is certified that error appears in the above-identified patent and that said Letters Patent are hereby corrected as shown below:

Column 23, Claim 9, after the word "mechanism" change "response" to "responsive"

Column 23, Claim 12, after the word "mechanism" change "response" to "responsive"

Column 23, Claim 13, after the word "mechanism" change "response" to "responsive"

Signed and Sealed this

Twenty-sixth Day of April 1983

[SEAL]

Attest:

GERALD J. MOSSINGHOFF

Attesting Officer

Commissioner of Patents and Trademarks